US006470630B1

(12) United States Patent
Miyamoto

(10) Patent No.: US 6,470,630 B1
(45) Date of Patent: Oct. 29, 2002

(54) AMUSEMENT FACILITY, CONTAINER FOR AMUSEMENT FACILITY AND INSTALLATION METHOD OF AMUSEMENT EQUIPMENT

(76) Inventor: Masafumi Miyamoto, 1804 Via Visalia, Palos Verdes Estates, CA (US) 90274

( * ) Notice: Subject to any disclaimer, the term of this patent is extended or adjusted under 35 U.S.C. 154(b) by 3 days.

(21) Appl. No.: 09/586,085

(22) Filed: Jun. 2, 2000

(30) Foreign Application Priority Data

Jun. 3, 1999 (JP) ..... 11-156360

(51) Int. Cl.[7] ..... E04H 1/00; E04H 3/10

(52) U.S. Cl. ..... 52/64; 52/79.1; 52/79.12

(58) Field of Search ..... 52/36.1, 36.2, 52/64, 79.1, 79.3, 79.4, 79.7, 79.8, 79.9, 79.12, 79.13

(56) References Cited

U.S. PATENT DOCUMENTS

| | | | | | |
|---|---|---|---|---|---|
| 2,499,498 | A | * | 3/1950 | Hammond, Jr. | 52/79.12 X |
| 3,388,512 | A | * | 6/1968 | Newman | 52/64 |
| 3,474,580 | A | * | 10/1969 | Smeeth | 52/79.12 X |
| 3,507,080 | A | * | 4/1970 | Van Hezik | 52/79.12 X |
| 3,525,186 | A | * | 8/1970 | Lombardo | 52/79.12 X |
| 3,541,744 | A | * | 11/1970 | Maxwell | 52/79.12 X |
| 3,553,911 | A | * | 1/1971 | Morrow et al. | 52/36.2 X |
| 3,613,321 | A | * | 10/1971 | Rohrer | 52/79.12 X |
| 3,623,296 | A | * | 11/1971 | Santoro | 52/79.12 |
| 3,638,380 | A | * | 2/1972 | Perri | 52/79.12 |
| 3,744,193 | A | * | 7/1973 | Lau | 52/79.12 X |
| 3,823,520 | A | * | 7/1974 | Ohta et al. | 52/79.12 X |
| 3,923,134 | A | * | 12/1975 | Rezazadeh | 52/79.1 X |
| 4,594,817 | A | * | 6/1986 | McLaren et al. | 52/79.12 X |
| 4,766,708 | A | * | 8/1988 | Sing | 52/79.12 X |
| 4,987,706 | A | * | 1/1991 | Hughes et al. | 52/79.1 X |
| 5,233,808 | A | * | 8/1993 | Salmenmaki et al. | 52/79.12 X |
| 5,265,384 | A | * | 11/1993 | Menke et al. | 52/79.1 |
| 5,316,480 | A | | 5/1994 | Ellsworth | |
| 5,335,614 | A | * | 8/1994 | Klaus | 52/79.1 X |
| 5,474,411 | A | | 12/1995 | Schoenfeld et al. | |
| 5,638,646 | A | * | 6/1997 | Shane | 52/79.1 |
| 5,993,216 | A | * | 11/1999 | Stogner | 52/36.2 X |

FOREIGN PATENT DOCUMENTS

| | | | | |
|---|---|---|---|---|
| DE | 2016762 | * | 11/1971 | 52/36.2 |
| FR | 1.012.589 | | 12/1952 | |
| FR | 75926 | * | 7/1964 | 52/79.12 |
| GB | 1067888 | * | 5/1967 | 52/79.3 |
| GB | 1095449 | | 12/1967 | |
| JP | 50-7846 | | 3/1975 | |
| JP | 52-8924 | | 7/1975 | |
| JP | 53-6457 | | 3/1978 | |
| JP | 54-57310 | | 5/1979 | |
| JP | 2-49862 | * | 2/1990 | 52/79.1 |
| JP | 05200163 | | 8/1993 | |
| JP | 06292287 | | 10/1994 | |
| JP | 6-316968 | | 11/1994 | |
| JP | 7-11711 | | 1/1995 | |
| JP | 7-286342 | | 10/1995 | |
| JP | 08038743 | | 2/1996 | |
| JP | 3029006 | | 7/1996 | |
| JP | 8-193361 | | 7/1996 | |
| JP | 08257245 | | 10/1996 | |

* cited by examiner

*Primary Examiner*—Laura A. Callo
(74) *Attorney, Agent, or Firm*—Clifford Chance Rogers & Wells LLP

(57) ABSTRACT

Amusement equipment can be easily installed in a building at low cost. Also, desired amusement equipment can be renewed easily and at low cost. In a building, an amusement facility is provided by installing a container provided therein with amusement equipment. The building is formed with an opening portion for carrying-in-and-out the container therethrough. A container supporting portion for permitting carrying-in-and-out the container is provided in the building. Accordingly, the container is placed on the container supporting portion through the opening portion to install the amusement equipment in the building. Also, by replacing the container in the building, the amusement equipment can be replaced.

17 Claims, 14 Drawing Sheets

AMUSEMENT FACILITY, CONTAINER FOR AMUSEMENT FACILITY AND INSTALLATION METHOD OF AMUSEMENT EQUIPMENT

This application is based on Patent Application No. 11-156360 (1999) filed on Jun. 3, 1999 in Japan, the content of which is incorporated hereinto by reference.

BACKGROUND OF THE INVENTION

1. Field of the Invention

The present invention relates to an amusement facility to be provided within a building.

2. Description of the Related Art

In general, there have been known amusement facilities such as a theme park, an amusement park, a movie theater, a game arcade and so on. In recent years, a relatively large scale amusement facility is provided in one building.

Different from a game arcade, in which arcade game machines are mainly arranged, the amusement facility provided in one building includes amusement equipment on the basis of a particular concept similar to the theme park. For example, such an amusement facility is provided with playland like vehicle type amusement equipment running on rails, a floor or the like, amusement equipment projecting a three-dimensional video image, simulator equipment reproducing acceleration feeling, up-and-down feeling of vehicles, such as a roller coaster, an air plain or the like by moving a seat or the like or a movie theater with satisfactory acoustic equipment, projection equipment and interior design and so on. Normally, the amusement facility is collectively provided with four to fifteen number of the above amusement equipment in combination.

Such an amusement facility can be provided in a busy downtown street in an urban area if a large building can be constructed. It is also possible to provide the amusement facility in combination with a shopping facility in the shopping facility and the like in a suburb area of a city. Accordingly, in a certain locational condition, marquee can be expected with the amusement facility alone, and in addition, a synergy effect in enhancing marquee can be expected in cooperation with the shopping facility.

Even the above amusement facility of relatively large scale to be provided in a large building, there is a low possibility that a proportion of tourists visiting from a remote area becomes high like a theme park. Conversely, there is a high possibility that a proportion of customers visiting from a close area becomes high.

Accordingly, the amusement facility set forth above is not necessarily unique over a relatively wide range. Even if similar amusement facilities are located in various places, there should be a little influence for marquee of each individual amusement facility. Accordingly, it is possible to provide a plurality of similar amusement facilities in suburb areas of a large city or to provide similar amusement facilities in respective cities and suburb areas thereof.

However, when a plurality of similar amusement facilities are provided, difficulties should be encountered, in view of locational conditions, to provide substantially the same shape and size for buildings, in which respective amusement facilities are installed. Therefore, each of amusement facilities has to be designed individually corresponding to the building, in which the facility is installed. Accordingly, a difficulty is encountered in that significantly lowering equipment cost cannot be expected even by a chain-store operation.

On the other hand, since the foregoing amusement facility requires larger scale amusement equipment in comparison with the arcade game machine, construction of the building, power sources and other equipment have to be adapted for the large amusement equipment. Therefore, the amusement facility is difficult to be installed in an existing building, and construction of a new building becomes necessary to possibly cause high costs.

On the other hand, in the amusement facility of the type set forth above, and particularly in the case of the chain-store operation, residents in a relatively narrow area should be primary customers. Therefore, it is important to catch repeaters repeatedly visiting the facility. However, in the amusement facility of the type set forth above, there are amusement facilities including not only amusement equipment expected to catch repeaters, such as a movie theater, in which repeaters can be attracted by sequentially exchanging movies to be played, but also amusement equipment which can be gotten tired of after playing for one or several times. In the later amusement equipment, a problem is encountered in that marquee can be lowered according to elapse of time after installation.

Furthermore, the amusement equipment of larger scale than the arcade game machine or the like, requires a substantial cost and a period from planning and designing until an installation of the amusement equipment when the existing amusement equipment is to be exchanged with new amusement equipment. In addition, a long period and a high cost should be required for actual refitting. Accordingly, in view of an economic viability, a difficulty is encountered in exchanging the amusement equipment even when marquee is lowered.

SUMMARY OF THE INVENTION

The present invention has been worked out in view of the problems set forth above. It is therefore an object of the present invention to provide an amusement facility, a container for amusement facility and an installation method of amusement equipment which can easily install amusement equipment in a building at a low cost and necessary amusement equipment can be refreshed at a low cost.

According to an aspect of the present invention, there is provided an amusement facility constructed by installing one or more containers containing amusement equipment therein, within a building, characterized in that;

the building is provided with an opening portion for carrying-in-and-out the container, and a container supporting portion is provided within the building for supporting the container to be carried-in-and-out through the opening portion.

With the construction set forth above, the opening portion and the container supporting portion are provided on the building side, and the amusement equipment is preliminarily installed in the container. Then, the container is carried into the building and installed on the container supporting portion to install the amusement equipment. Thus, the amusement facility including the amusement equipment can be easily constructed.

On the other hand, the opening portion on the building side, the container supporting portion and the container are preliminarily standardized respectively, the amusement equipment can be installed in any building and modification of the design of the amusement equipment becomes unnecessary. Therefore, in a chain-store operation with similar amusement equipment, cost can be lowered. In other words, the chain-store operation can be easily effected with similar amusement equipment at low cost. Furthermore, by this chain-store operation, the same amusement equipment can be installed in a plurality of amusement facilities to facilitate collection of the investment for planning and designing of the amusement equipment.

On the other hand, since the container supporting portion of the building supports the container containing the amusement equipment for easily carrying-in-and-out through the opening portion, by replacing the container installed in the building with other container, the amusement equipment can be easily replaced. Accordingly, by replacing the amusement equipment, marquee of which is lowered, with another amusement equipment, the marquee can be easily recovered and increasing of repeaters can be promoted.

On the other hand, by replacing the container, the amusement equipment can be easily replaced. Therefore, a period required for changing the amusement equipment can be shortened remarkably. Thus, loss of income due to down period for face-lifting can be minimized.

The building can be any constructions as long as a large opening portion can be formed on at least one surface irrespective of building materials, such as structures, such as a reinforcement structure, a reinforced concrete structure, a reinforced steel frame concrete structure, such as by including bent. On the other hand, the opening portion of the building may be opened and closed by providing an opening and closing member, such as a shutter or the like or by arranging a detachable curtain wall. The rear end face of the container may form a part of the external wall of the building.

The container supporting portion may be any constructions for carrying-in-and-out the container through the opening portion of the building. Upon installation of the container in the building, it is preferred to detachably fix the container. For fixing the container to the container supporting portion, known bolts or various joining members may be used. On the other hand, the member for fixing the container may be a connecting member having a movable portion and it automatically fixes the container upon installation of the container.

Further, the container supporting portion may have a portion, on which the container is installed, slidably supporting the container upon movably supporting the container. For example, wheels or rollers or the like may be provided on the container side, and the portion rotatably supports the wheels or rollers. On the other hand, the container supporting portion may have a conveyer structure, such as a belt conveyer, a roller conveyer or the like.

The container may have a sufficient strength for installing the amusement equipment therein, and can be transported. The container is not required to have a strength as a part of the body of the building.

On the other hand, the containers may be arranged adjacently or connected with each other to form one amusement equipment, such as a movie theater. When the amusement equipment for one function from fractions of the amusement equipment arranged in a plurality of containers, or, in consideration of entering and exiting into and from the space in the building other than the space where the container is installed, a construction which can provide an opening portion easily, is preferred. For example, a frame like structure is preferred. However, the container of the present invention may be one having face plates surrounding respective outer surfaces thereof. Then, the opening portion may be formed in the face plate portion.

The amusement equipment can be equipment having a screen and projecting equipment (including not only a typical movie theater but also one capable of projecting a three-dimensional screen image, one having a substantially hemisphere screen, one having multiple screens, one having special effects, such as a feeling of smell, aroma, temperature and the like, acceleration feeling and/or up-and-down feeling by motion of chair or the like, can be experienced in addition to a screen image and sound), one providing a virtual experience of riding on a riding tool, such as skis, a snow board, roller skates, a skate board or the like, one providing a virtual experience of sporting, such as fishing, throwing a ball, batting or the like, one providing a virtual experience of controlling an automobile, a motorcycle, a ship, an air plain, an electric car or the like (including a simulator of an air plain, an electric car or the like), one reproducing a city, and so on. However, the amusement to be enjoyed in the amusement equipment should not be specified to those listed above and can be any equipment which can be used within the building.

Accordingly, the equipment is not only for watching moving pictures, providing virtual experiences and so on, but can be any entertainment equipment, such as bowling alleys, a squash field, a gymnastic hall, a body shop and so forth permitting actual sporting or training as long as capable of installing in the space of one or a plurality of containers. Furthermore, the equipment may be typical entertainment equipment to be installed in the building.

Here, the container supporting portion may include a guide member formed in a portion adjacent to the opening portion in the building, and the guide member guiding the container along a direction for carrying-in-and-out the container.

With the construction set forth above, by guiding carrying-in-and-out the container by means of the guiding member, the container can be certainly carried-in-and-out.

It should be noted that the guiding member may have any structure capable of guiding motion for carrying-in-and-out the container by restricting movement in directions other than the direction of carrying the container in and out the building. For example, the guide member may be a rail, on which the container may engage for movement in the direction of carrying-in-and-out. It should be appreciated that the rail may be one guiding movement of the container as mounted thereon, or, in the alternative, can be one guiding movement of the container in a hanged condition. It is also possible that the container is installed in a condition rigidly secured by means of bolts, joining members, connecting members and so on.

Furthermore, in the amusement facility it is preferred to further comprise a container carrying-in-and-out actuation means for drawing the container from the outside of the building within the building along the guide member and pushing out the container arranged within the building along the guide member.

With the construction set forth above, by an elevating means, such as a crane or the like, the container arranged in front of the opening portion of the building is drawn by the container carrying-in-and-out actuation means in the condition guided by the guiding member. Thus, the container can be easily installed in the building. On the other hand, the container arranged in the building can be easily pushed out of the building in the condition guided by the guiding member. It should be appreciated that, at this time, in order to prevent the pushed out container from falling down, a means for supporting the container outside of the building may be arranged, or in the alternative, the container is pushed out in the condition preliminarily connected to a hanger of the crane and in synchronism with an action of the crane.

The container carrying-in-and-out actuation means may employ a known hydraulic cylinder, a combination of a winch and a wire (and wheel), a combination of a motor, a chain and a sprocket, a combination of rack and pinion, a worm screw and so on.

It should be appreciated that the container supporting portion may include an extendable container supporting member movable between a condition retracted into said building and a condition extended outwardly through the opening portion, and a container supporting member actuation means for actuating the extendable container supporting member, whereby the extendable container supporting member takes the container in and out of the building with the extendable container supporting member being moved in a condition mounting the container.

With the construction set forth above, upon lifting up and down the container by the crane as the elevating means, it becomes difficult to feed the container in the building from the opening portion in parallel movement for interference with the building. It becomes possible to easily feed the container by mounting the container on the extendable container supporting member in the condition extended outside from the opening portion of the building after hanging the container by the crane and retracting the extendable container supporting member in this condition. On the other hand, with the construction set forth above, the container installed in the building can be fed out of the building by the extendable container supporting member. In this condition, the container can be easily hanged down by the crane, It should be noted that the extendable container supporting member may be a plate form or a frame form member movable along the extending direction and fitted to a member rigidly secured on the building side, and has to have a strength sufficient for supporting the container in the extended condition.

On the other hand, the container supporting member actuation means may be similar to the container carrying-in-and-out actuation means.

Furthermore, the building may be an existing one, the opening portion is formed in the existing building, and the container supporting member may be provided in the existing building.

With the construction set forth above, upon providing the amusement equipment, the equipment can be provided in an existing building. Therefore, a cost can be lowered in comparison with the case where the building having the amusement facility is newly constructed. It should be appreciated that when the building has a frame construction, for example, a large opening portion can be easily formed by removing a curtain wall. Then, by only providing the container supporting member in the form of a floor frame, carrying in and installation of the container in the existing building becomes possible. On the other hand, even in the building other than frame construction, the large opening portion may be formed in an exterior wall portion as long as the building has an exterior wall not serving as a bearing wall.

Moreover, the amusement facility may further comprise an elevating means for elevating the container, and a sliding supporting portion is provided in the elevating means for slidably supporting the container with the building.

With the construction set forth above, even if the elevating means is the crane, for example, the container can be easily drawn within the building by hanging the container via the sliding supporting member and making the container slidable on the sliding supporting member. Particularly, by providing a connecting portion connecting the sliding supporting member to the building and slidingly moving the container in the condition where the sliding supporting member is connected to the building, for example, drawing of the container into the building can be more facilitated. Also, by making the sliding supporting member connectable with the building, the container can be easily taken out by pushing the container from the building with supporting the container by the sliding supporting member in the condition connecting the sliding supporting member to the building.

It should be noted that the sliding supporting member may have a guiding member engaging with the container in the condition permitting movement in the direction for carrying the container in and out the building, for example. The sliding supporting member may support the container in the condition mounted thereon or in the condition hanged therefrom. Also, the elevating means may be a hanging device, such as a crane or the like, or a vehicle for high lift work. It should be appreciated that the crane may be typical one extracting and retracting the wire from a tip end portion of one arm, or, in the alternative, may have a construction to hand the container in the same manner as a crane for container in a container ship.

Further, it is preferred that in the elevating means, provided is a container carrying-in-and-out means for pushing the container supported on the sliding supporting portion in the building and drawing the container in the building onto the sliding supporting portion.

With the construction set forth above, by the container carrying-in-and-out means, the container supported by the sliding supporting portion can be easily carried into the building by pushing the container, and can be carried out by drawing the container in the building toward the sliding supporting portion.

It should be appreciated that, in this case, the sliding supporting portion has a structure to be connected to the building to receive a reactive force from the building during movement of the container.

On the other hand, the container carrying-in-and-out means may be similar to the container carrying-in-and-out actuation means, for example.

Furthermore, the elevating means may be one movable on a road.

With the above, only when the container is carried in or out, the elevating means is moved in the vicinity of the building for use. Therefore, the elevating means is not necessarily dedicated for one building to contribute for lowering of the cost.

It should be noted that in the elevating means, while the sliding supporting member, the container carrying-in-and-out means, for example, are dedicated for the container of the present invention, rest part of the elevating means may be a general self propelling type crane or a vehicle for high lift work.

On the other hand, the elevating means may be one provided on the building.

With the construction set forth above, since the elevating means is provided on the building, the carrying-in-and-out of the container can be performed easily. By providing the elevating means on the building, it can be an elevating means having a structure similar to the dedicated crane to further facilitate elevating the container up and down, for example.

It should be appreciated that the elevating means may be provided on the rooftop portion of the building, for example. It is also possible to leave a crane used for lifting up constructional materials during construction of the building without removing it so as to use it as the elevating means.

Furthermore, it is preferable that in the building, at least one of wiring and piping to be connected to the container is arranged and a building side connecting portion for connecting the at least one of wiring and piping to the container side is provided, in the container, at least one of wiring and piping to be connected to the building is arranged and a container side connecting portion for connecting the at least one of wiring and piping to the building side is provided, and among the building side connecting portion and the container side connecting portion, at least one of connecting portions is movable toward the other of connecting portions, and one connecting portion being moved toward the other connecting portion to detachably connect the connecting portions with each other.

With the construction set forth above, at least one of the connecting portions of the building side connecting portion and the container side connecting portion is moved toward the other connecting portion to establish connection for easily connecting the wiring and piping between the building side and the container side.

It should be noted that the connecting portion which is adapted for movement, may be moved by a driving means, for example. With this construction, the movable connecting portion can be easily moved. In this case, it is preferred that at least one of the connecting portions is mounted in a condition having play for movement for a little distance in a direction perpendicular to the moving direction. Also, at this time, one of the connecting portions is provided with a bar like projecting portion, for example, and the other connecting portion is provided with a conical shaped or funnel shaped hole, into which the projecting portion is inserted, for example. It is preferred that by inserting the foregoing projecting portion into the hole, the connecting portions are connected in the condition accurately positioned with respect to each other. On the other hand, at least one of the projecting portions is mounted via a resilient or elastic member so that the resilient or elastic member may absorb shock upon connection between the connecting portions. It should be appreciated that as the connecting portions of the wiring and the piping, known connection structures may be employed.

Furthermore, it is preferred that a moving direction of the container from the opening portion when carried in and a moving direction of the container side connecting portion toward the building side connecting portion are consistent, and the container side connecting portion and the building side connecting portion are arranged so as to establish connection between the container side connecting portion and the building side connecting portion when the container is located at an installation position upon completion of movement of the container carried-in.

With the construction set forth above, upon carrying in and installing the container, the container side connecting portion and the building side connecting portion are connected so that an arrangement of the wiring and piping can be completed only by installing the container, allowing to place respective equipment in the container in the states ready for use.

It should be noted that at least one of connecting portions is preferably placed in a condition having play. On the other hand, it is preferred that the connecting portion has a structure to permit positioning as set forth above. It is also preferred to absorb the shock upon connection by the resilient or elastic member, as set forth above.

It should be noted that the wiring may be for performing at least one of power supply and transmission and reception of a signal, and the piping may be for performing at least one of air conditioning, a hydraulic pressure supply, a compressed air supply, a smell supply, a hot air and cold air supply, a waster supply and drainage, a coolant supply and a hot water supply.

With the construction set forth above, a power supply for the container can be easily done. In conjunction therewith, transmission and reception of the signals can be done easily. When a sequence of amusement equipment extends over a plurality of containers, for example, or when a mutual fight can be performed by respective arcade game machines with a plurality of mutual fighting type arcade game machines being arranged over a plurality of containers, for example, the signal may a signal for enabling mutual fighting between the arcade game machines. On the other hand, the signal may be a signal for controlling the amusement equipment within the container. Furthermore, the signal may be a signal for delivering program or the like from outside of the container in order to actuate the amusement equipment in the container. Similarly, the signal may be a signal for delivering video and audio data from the outside for use in the amusement equipment in the container. On the other hand, the signal may be a signal output to a control room outside of the container from various sensors installed within the container.

Furthermore, in addition to the container, in which amusement equipment is provided, a container provided with utility equipment may be supported on the container supporting portion in the building to be carried-in-and-out through the opening portion similarly to the container provided with the amusement equipment therein.

With the construction set forth above, since it becomes unnecessary to provide utility equipment for the container to be installed in the building, designing and construction of the building can be facilitated when a building with the amusement facility according to the present invention is to be newly constructed.

On the other hand, upon installing the amusement facility of the present invention in the existing building, modification of the construction on the existing building side can be minimized.

It should be noted that the utility equipment is as listed below. However, the utility equipment may also be a rest room, a kiosk or the like.

The utility equipment in the utility equipment containing container may perform at least one of a power supply and transmission and reception of a signal, air conditioning, a hydraulic pressure supply, a compressed air supply, a smell supply, a hot air and cold air supply, a waster supply and drainage, a coolant supply and a hot water supply, for the container provided with the amusement equipment therein.

With the construction set forth above, even when a power supply equipment for supplying sufficient power for the amusement facility is not provided on the building side, for example, power can be supplied to respective containers by externally connecting a power cable to the container having the utility equipment therein. Similarly, even when equipment for power supply and transmission and reception of a signal, air conditioning, a hydraulic pressure supply, a compressed air supply, a smell supply, a hot air and cold air supply, a water supply and drainage, a coolant supply and a hot water supply are not provided on the building side, such function may be satisfied by the container having the utility equipment.

Namely, for the amusement facility, equipment not necessary for the normal building or equipment (such as air conditioner) having higher performance for gathering of large number of people, can be required. By installing the container having the utility equipment, these extra equipment may not be required to be provided on the building side. Therefore, designing and construction of the building can be facilitated. Furthermore, this permits the amusement facility of the present invention to be installed in the existing building.

Furthermore, a plurality of the containers may be arranged within one building to form an amusement space containing a plurality of amusement equipment.

With the construction set forth above, by installing a plurality of containers in one building, while there is a spatial limitation as being in the building, a space provided with a plurality of amusement equipment like a theme park, a playland, a cinema complex and so forth, can be provided.

It should be appreciated that the amusement equipment in one container is not necessarily one equipment but can be a fraction of the amusement equipment so that the amusement equipment in a plurality of containers may function as one amusement equipment.

On the other hand, it is preferred that the opening portion and the container supporting portion of the building are provided corresponding to one or more sizes of standardized containers.

With the construction set forth above, the equipment on the building side of the amusement equipment of the present invention, namely the opening portion and the container supporting portion are standardized to facilitate construction and modification of the building when the amusement facilities are provided in a plurality of buildings.

It should be appreciated that by providing a plurality kinds of standards for the container instead of providing only one kind of standard, the containers may be easily adapted to the size of the building and/or size of the amusement equipment while some disadvantage is expected in a viewpoint of cost. Thus, formation of a waste space in the container and/or building can be avoided.

Furthermore, a plurality of the containers installed adjacent with each other or connected with each other may be communicated with each other through an opening portion formed in a wall across which the containers are adjacent, and amusement equipment contained in respective containers are combined to form an integrated single amusement equipment.

With the construction set forth above, even if the size of the container is restricted by environmental conditions, such as a condition of roads to be passed in transporting the container, relatively large amusement equipment, such as a movie theater, can be formed by combining a plurality of containers. Thus, the amusement equipment is not limited to that of small scale.

It should be appreciated that directions to combine a plurality of containers is not limited in the horizontal direction, such as in a lateral direction or a back-and-forth direction for combining horizontally adjacent containers, but can be in the vertical direction to combine vertically adjacent containers. Also, since some building has a span of upper and lower beams for two flowers instead of one flower, the containers may be arranged to combine respective amusement equipment even in the vertical direction between the upper and lower beams. On the other hand, at this time, an up and down going construction, such as stairs, may be provided between the vertically combined containers.

Here, the amusement equipment serving as integrated single amusement equipment as combined may have a function as attraction equipment, movie projecting equipment, video game equipment and the like.

With the construction set forth above, the amusement equipment having functions of attraction equipment, which will become more attractive when arranged in a wider space, movie projecting equipment and arcade video game equipment and so on can be provided by installing a plurality of containers.

It should be appreciated that the attraction equipment, movie projecting equipment, arcade video game equipment and so on may be provided in a narrower space. However, a smaller screen in the movie theater may provide a smaller difference from watching a television at home to degrade an entertaining ability as the amusement facility. Namely, in the amusement facility, a scale of the equipment, a scale of the space, and a number of gathering people and the like should be important factors for determining the entertaining ability, so that in a certain kind of amusement facility, a greater scale can enhance the entertaining ability. Therefore, by forming a large space by combining a plurality of containers and providing the foregoing amusement equipment in such a large space, the entertaining ability of the amusement facility employing the containers of the present invention can be enhanced.

Here, the amusement equipment arranged in one or more containers may be controlled by a signal input from outside of the container, in which the amusement equipment is arranged.

With the construction set forth above, the amusement equipment within the container can be controlled by the signal from outside of the container. Namely, the control of the equipment in each container can be controlled externally. For example, the air conditioning unit, the lighting unit, the sound unit may be arranged within the container as basic equipment of the amusement equipment, the control of such units may be done from outside of the container. Accordingly, it becomes unnecessary to provide devices for adjusting set values by the managing staff. Thus, the limited space in the container can be effectively used.

On the other hand, when the equipment in the container can be controlled externally, a control terminal for concentrically controlling equipment in respective containers may be provided. The control terminal may be provided as one of utility equipment in the container installed with the utility equipment. On the other hand, the basic units, such as an air conditioning unit, a lighting unit, a sound unit and the like are installed in most of the containers, and have a general applicability. Therefore, by installing the equipment which can be controlled in the same manner, control of the basic equipment by the control terminal can be maintained even when the amusement equipment are renewed by replacing the containers.

It should be appreciated that the amusement equipment to be controlled by the signal from outside is not limited to the basic equipment set forth above. Instead, the control terminal may also control the equipment respectively unique in respective containers, such as movie projecting equipment or driving equipment providing an acceleration feeling or an up-and-down feeling in the simulator or the like.

On the other hand, it is preferred that a content of amusement in the amusement equipment arranged in one or more containers can be varied by exchanging an electronic board loaded in the amusement equipment.

With the construction set forth above, in the equipment having a general applicability in which a content of a play can be varied, for example, by varying motion of a screen image or a driving portion to be used in the amusement equipment by changing the electronic board, the content of the play can be easily varied by rewriting the control program of the driving portion, the video and audio data with the data supplied from the outside of the container.

For example, in the amusement equipment for virtual driving of a racing car, it is possible to vary the racing course, or to vary the action of the racing car for virtual racing from an on-road action to an off-road action. On the other hand, in the movie theater providing the acceleration feeling or the up-and-down feeling by action of the chair, the motion of the chair can be easily adapted to the movie by exchanging the electronic board. Further, with the construction set forth above, not only modification of the software for version-up and so on but also modification of the hardware for version-up and so on becomes possible. Thus, more advanced amusement can be provided.

According to another aspect of the present invention, there is provided a container for an amusement facility to be used in the amusement facility, wherein amusement equipment is installed in the container before installation within a building.

With the construction set forth above, upon installation of the container in the building, the amusement facility is situated in a substantially completely constructed condition. Therefore, by exchanging the containers, exchanging of the amusement equipment can also be almost completed.

Here, it is preferred that the container is rectangular parallelepiped or substantially rectangular parallelepiped shape and one or more sizes thereof are standardized.

With the construction set forth above, by standardizing the size of the container, a mass production of the container can be easily performed. In addition, it is also possible to standardize equipment on the building side and equipment in the container. By this, when the amusement facilities according to the invention are placed in a chain-store operation, it becomes possible to cost down of the containers, the equipment in the container, the equipment on the building side and the like.

Here, it is preferred that the container includes a framework formed with a rectangular frame arranged in a ceiling portion, a rectangular frame arranged in a bottom portion and pillar frames vertically arranged for connecting respective four corners of the ceiling and bottom frames, and each equipment is provided in the framework.

With the construction set forth above, since the container has a frame structure, when the equipment in a plurality of containers are assembled, the containers adjacent in lateral, back and forth or vertical direction can be easily communicated with each other to facilitate combining of the equipment.

It should be noted that the openings in the container may be closed by attaching face panels as required. On the other hand, crossbars for reinforcement or parts mounting may be mounted on the frame portion.

Furthermore, a floor surface may be formed at a position spaced apart from a bottom surface thereof for arranging at least one of wiring and piping in a clearance defined between the floor surface and the bottom surface, and a connecting portion for connecting the at least one of the wiring and piping to building side may be externally exposed.

With the construction set forth above, by providing the floor surface above the bottom surface of the container and by arranging the wiring and piping within the clearance defined between the floor surface and the bottom surface, the space within the container can be effectively used. It should be noted that the floor surface is not necessarily extend to cover the entire bottom surface. Namely, for the position where the equipment is installed, the floor surface may not be provided so as to directly support the equipment by the bottom portion of the container. On the other hand, when the containers adjacent vertically are combined, the floor surface of the upper container may not be provided.

According to a further aspect of the present invention, there is provided an amusement equipment installation method for installing amusement equipment in an amusement facility, comprising the steps of:

transporting a container provided therein with amusement equipment to a building, carrying the container in the building through an opening portion formed in the building, and installing the container in the building by supporting on a container supporting portion.

With the above, the amusement facility can be easily provided by carrying the container into the building and installing the container.

Here, a plurality of the containers are installed in a plurality of the amusement facilities, respectively, the containers may be manufactured in a factory, and amusement equipment or utility equipment for the container containing the amusement equipment may be installed in the containers in the factory.

With the above, by a mass production of the container and by making the amusement equipment in the container common in various amusement facilities, lowering of manufacturing cost can be achieved. It should be noted that a factory of manufacturing the container, a factory of manufacturing the amusement equipment, and a factory of installing the amusement equipment in the containers may be independent of each other. However, when the container size is large, it is preferred that the factory of the container and the factory of the amusement equipment are common or are located close to each other.

Furthermore, the amusement equipment installation method may further comprise the step of installing another amusement equipment in the building in place of an existing amusement equipment by carrying in a container containing the another amusement equipment after carrying out a container containing the existing amusement equipment in the building.

With the above method, the amusement equipment, marquee of which has been lowered, can be exchanged easily by exchanging the container. On the other hand, since the amusement equipment can be exchanged in a short period by exchanging the container, long down period becomes avoided. Thus, the amusement equipment can be exchanged at low cost. Furthermore, by frequent exchange of the amusement equipment, increasing of repeaters can be promoted.

On the other hand, the amusement equipment installation method may further comprise the steps of;

carrying out the container installed in the building, carrying in the container just carried out in another building, and installing the container in the another building.

With the above method, one container can be used for a plurality of amusement facilities to permit exchanging of the amusement equipment at low cost. On the other hand, even for the building, in which a large number of amusement equipment cannot be installed, by exchanging the amusement equipment with other amusement facility in the similar building, greater variety of amusement equipment can be provided for the customer.

It should be noted that, when the container once installed in one building is to be installed in another building, it may be carried into the factory for maintenance before installation in another building. In some cases, a part or a whole of the amusement equipment in the container is exchanged before installation in another building.

The above and other objects, effects, features and advantages of the present invention will become more apparent from the following description of embodiments thereof taken in conjunction with the accompanying drawings.

DETAILED DESCRIPTION OF THE PREFERRED EMBODIMENT

The preferred embodiment of the present invention will be described hereinafter in detail with reference to the drawings.

Figure 1:
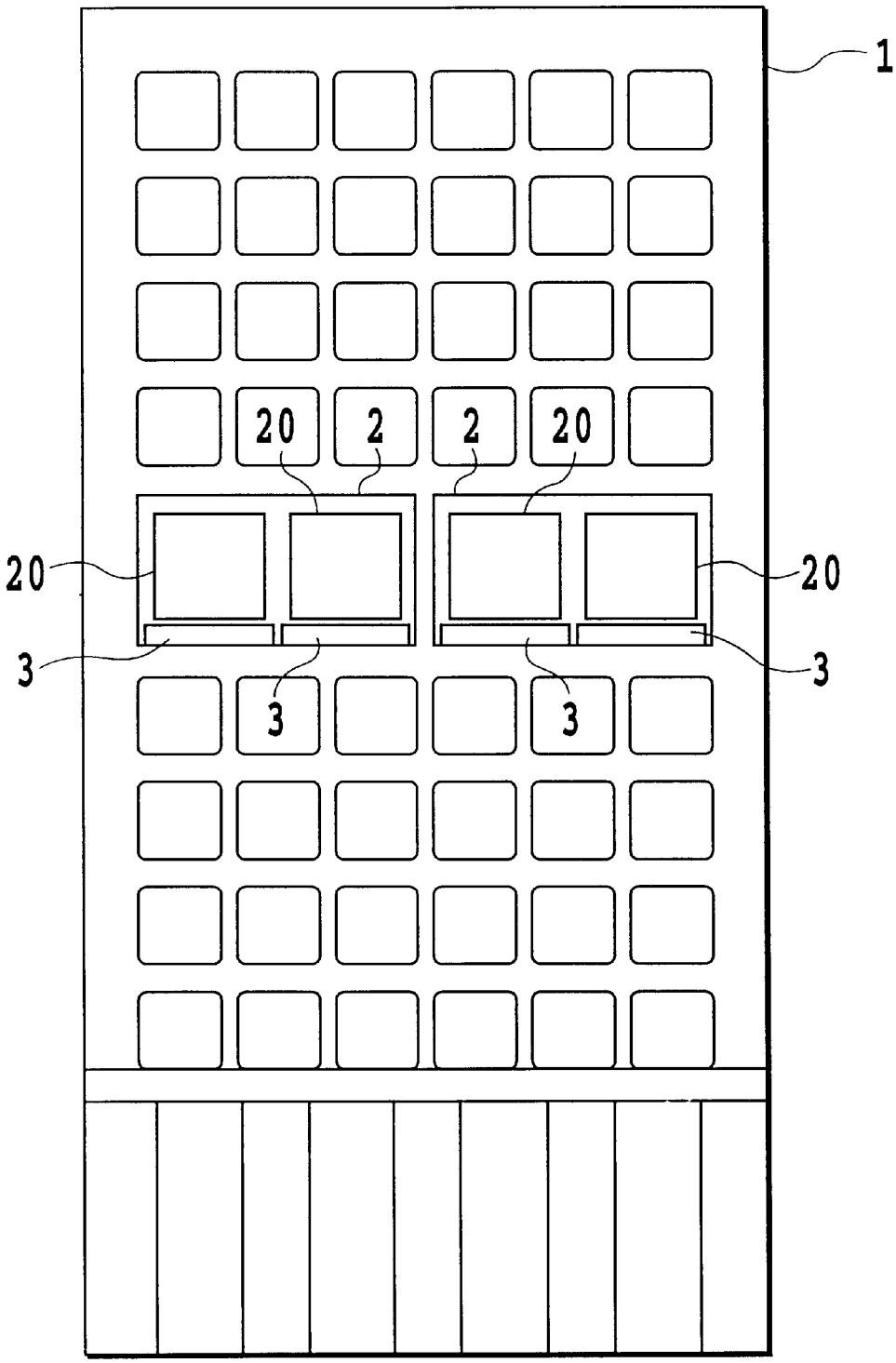
FIG. 1 is a front elevation showing a general construction of a building, in which one embodiment of an amusement facility according to the present invention is provided.

FIG. 1 generally shows an amusement facility of the present invention. As shown in FIG. 1, the amusement facility according to the present invention is installed within a building 1, and includes a container 20, in which amusement equipment (not shown) is mounted or attached.

The building 1 is provided with a shopping facility or the like, such as that of a department store, a supermarket and the like. The foregoing containers 20 are installed in a part of the building. A portion where the containers 20 are installed, is one floor or several floors of the building. These floors comprise spaces for the amusement facility to be installed within the building. The building 1 is not limited to those set forth above but can be any buildings, such as various tenant buildings, office buildings and so on irrespective of application thereof. Also, number of floors in the building is not specific but can be of any low rise, medium rise or high rise building. It is also possible that the amusement facility occupies most floors or all of floors of the building. On the other hand, the building 1 may be the existing building and the amusement facility of the present invention is installed later, or, in the alternative, the amusement facility of the present invention can be constructed together with the building.

The building 1 is provided with a large opening portion 2 for carrying-in-and-out the container 20. Therefore, the building 1 is required to have a construction which permits formation of the large opening portion 2 in a wall, and thus is required that at least one of external walls among external walls around the building 1 is not a bearing wall and thus permits formation of the large opening portion 2.

The opening portion 2 has a size permitting feeding the container 20 in and out therethrough. On the other hand, the opening portion 2 is designed to be covered by a detachable curtain wall (not shown), for example.

The opening portion 2 may have a size permitting feeding one container 20 in and out therethrough or a size permitting feeding a plurality of containers 20 in and out. Also, for opening and closing the opening portion 2, a swing door, a sliding door, various shutters and so on may be employed in place of the curtain wall.

Then, on a floor surface in the opening portion, a container supporting portion 3 for supporting the container 20 to be carried-in-and-out, is provided.

The container 20 is loaded on the container supporting portion 3. Namely, the container 20 is detachably secured to the container supporting portion 3. The container supporting portion 3 is not necessarily provided on the floor surface. Instead, it is possible to arrange the container supporting portion 3 as a replacement of the floor in the portion where the container supporting portion 3 is provided, with connecting the container supporting portion 3 to a building frame on the building side, for example. On the other hand, the container supporting portion 3 is not specified to the shape for mounting the container 20 thereon, but can be of shapes supporting the container 20 in a hanged condition, or supporting both lateral side portions of the container 20. In these cases, the container supporting portion 3 is not provided on the floor surface.

Figure 2:
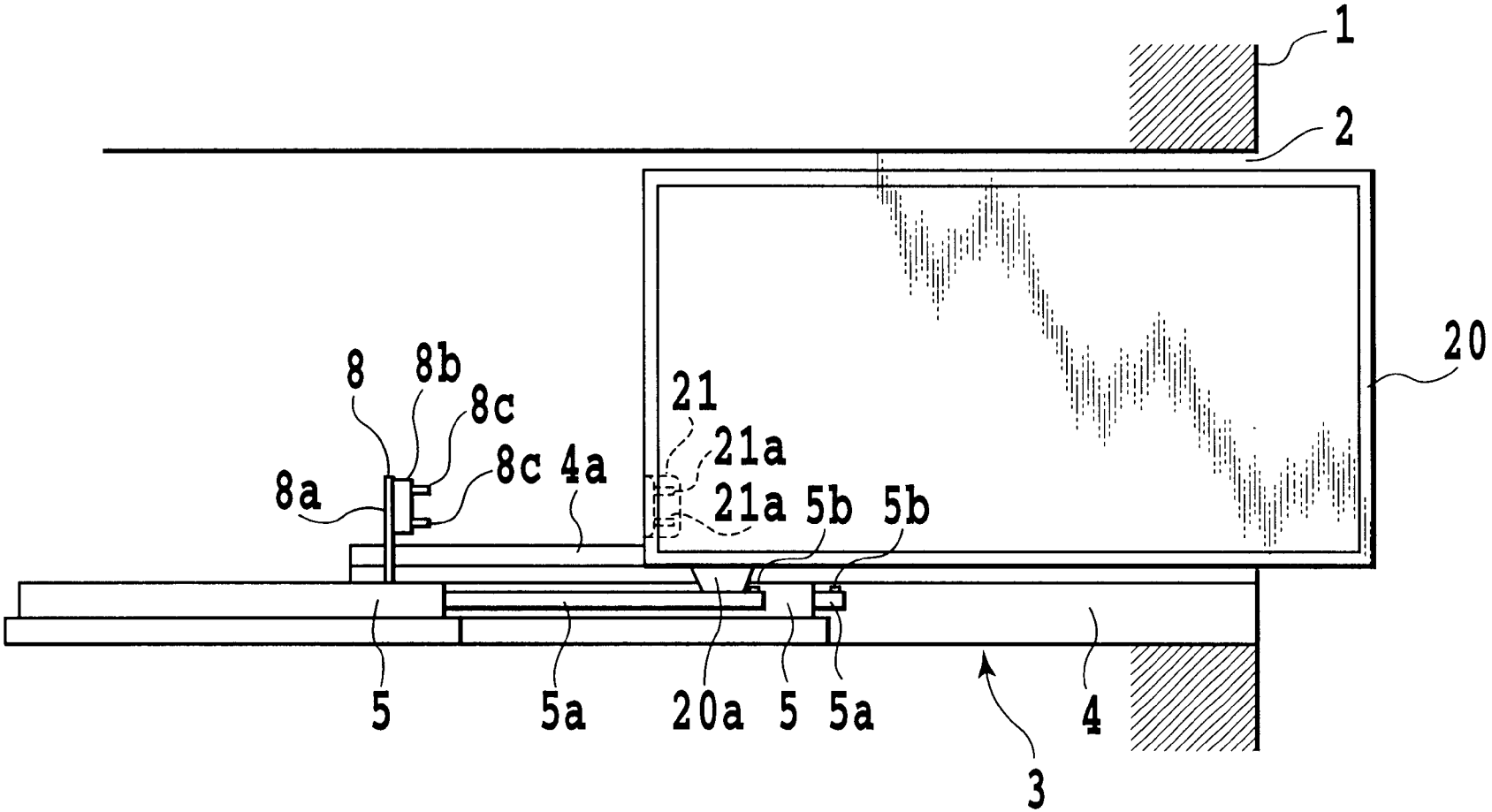
FIG. 2 is a schematic illustration showing a container supporting portion, a container carrying-in-and-out actuation means and a connecting portion for wiring and piping, in the preferred embodiment of the amusement facility.
Figure 3:
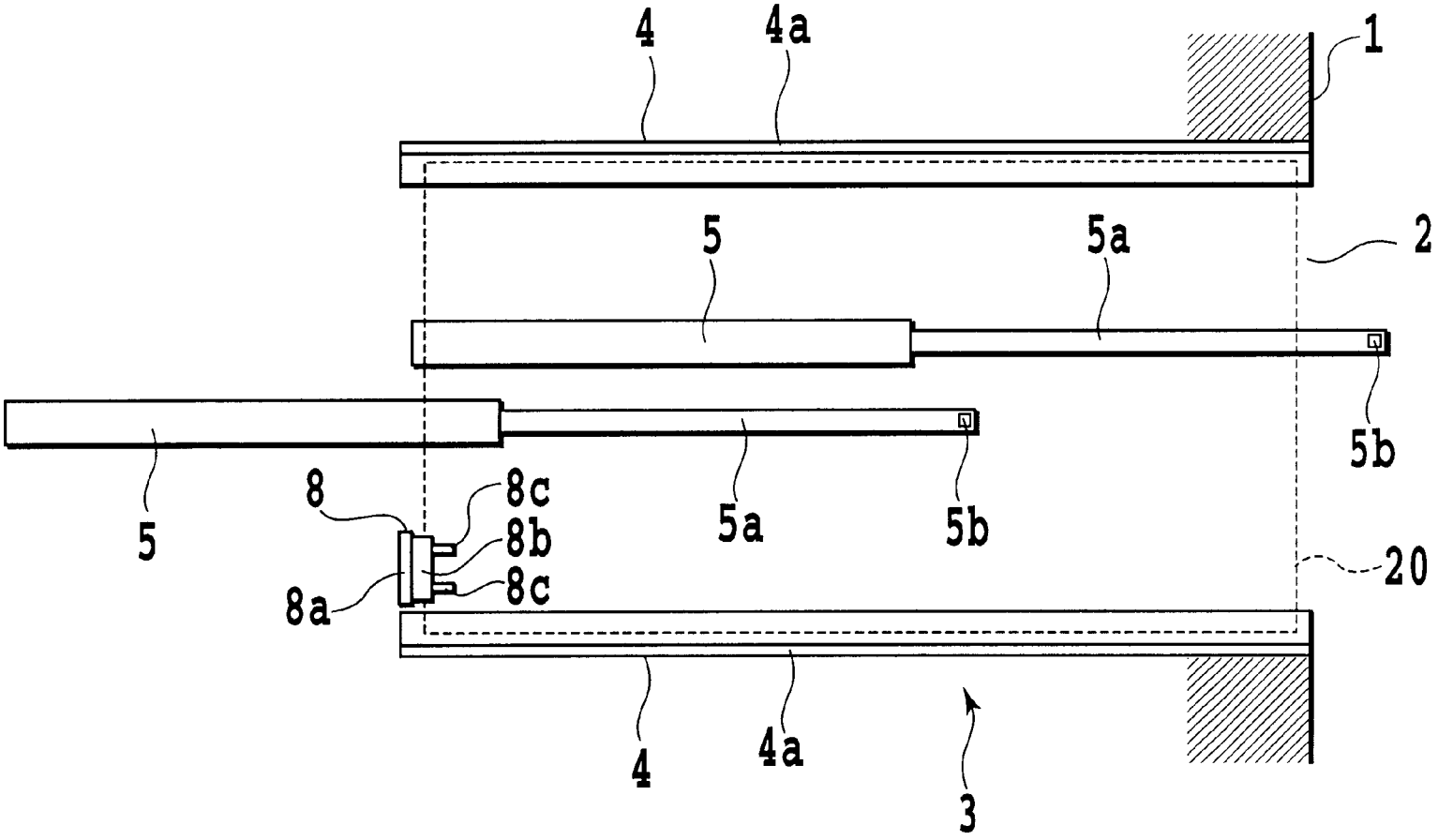
FIG. 3 is a schematic illustration showing the container supporting portion, the container carrying-in-and-out actuation means and the connecting portion for wiring and piping, in the preferred embodiment of the amusement facility.

The container supporting portion 3 may be rails 4 as shown in FIGS. 2 and 3. Two rails 4 are arranged in a spaced apart parallel relationship with a distance slightly smaller than a width of the container 20, and are oriented in a longitudinal direction matching with a direction for carrying-in-and-out the container 20. The rails 4 slidably support the container 20 with mounting the lateral side edge portions thereof on upper surfaces thereof. Also, the rails 4 are provided with restricting members 4*a*, respectively, for restricting lateral movement of the container 20, and guide the container 20 to be carried-in-and-out. The container 20 arranged on the rails 4 is detachably secured to the rails by means of bolts, for example.

The container supporting portion 3 is not specified to the rails 4 set forth above, but can be of a flat shape plate, those formed with a plurality of rails or those of various conveyer forms. Also, a manner of detachably securing the container 20 to the container supporting portion 3 is not limited to that employing the bolts, but can be those using various joint members and connecting members. In the case of the connecting members, upon arranging the container 20 to an installation position by moving on the container supporting portion 3, a clamp (not shown) provided on the container side supporting portion 3 or the container 20, may automatically catch a portion to be gripped (not shown) provided on the container side 20 or the container supporting portion 3 to connect the container 20 and the container supporting portion 3, for example.

On the other hand, in the building 1, hydraulic cylinders 5 serving as a container carrying-in-and-out actuation means for bringing the container 20 elevated up to a height opposing to the opening portion 2 onto the container supporting portion 3 within the building 1 and pushing the container 20 on the rails 4 out, are provided. Two hydraulic cylinders 5 are arranged in axially offset positions for drawing in and pushing out the container 20 in two stages.

On the other hand, on tip end portions of piston rods 5*a* of the hydraulic cylinders 5, engaging portions 5*b* which can be projected from and retracted into the tip end are provided so that they may engage with engaging projecting portions 20*a* arranged on the side of the bottom surface of the container 20.

It should be appreciated that, in the foregoing container carrying-in-and-out actuation means, two hydraulic cylinders 5 are oriented in the same direction, however, these hydraulic cylinders 5 may be oriented in mutually opposite directions. By this arrangement, it becomes possible to prevent the hydraulic cylinders 5 from extending over a long distance on the opposite side of the opening portion 2 from the installation position of the container 20. On the other hand, it is also possible to arrange a floor panel over the portion where the hydraulic cylinders 5 extends on the opposite side of the opening portion 2 from the installation position of the container 20.

The container carrying-in-and-out actuation means is not specified to the hydraulic cylinders 5 set forth above, but can be a means for actuating for movement of an engaging member engaging with the container 20 along a direction for carrying-in-and-out the container by means of a winch, a wire and a sheave, a means for actuating the engaging member by means of a rack and a pinion, and a means for driving the engaging member by means of a chain and a sprocket. Also, an engaging member meshing with a worm screw and driven by the worm screw in the manner set forth above. Furthermore, an engaging member driven in the direction for carrying-in-and-out the container 20 by another method may be employed.

Figure 4:
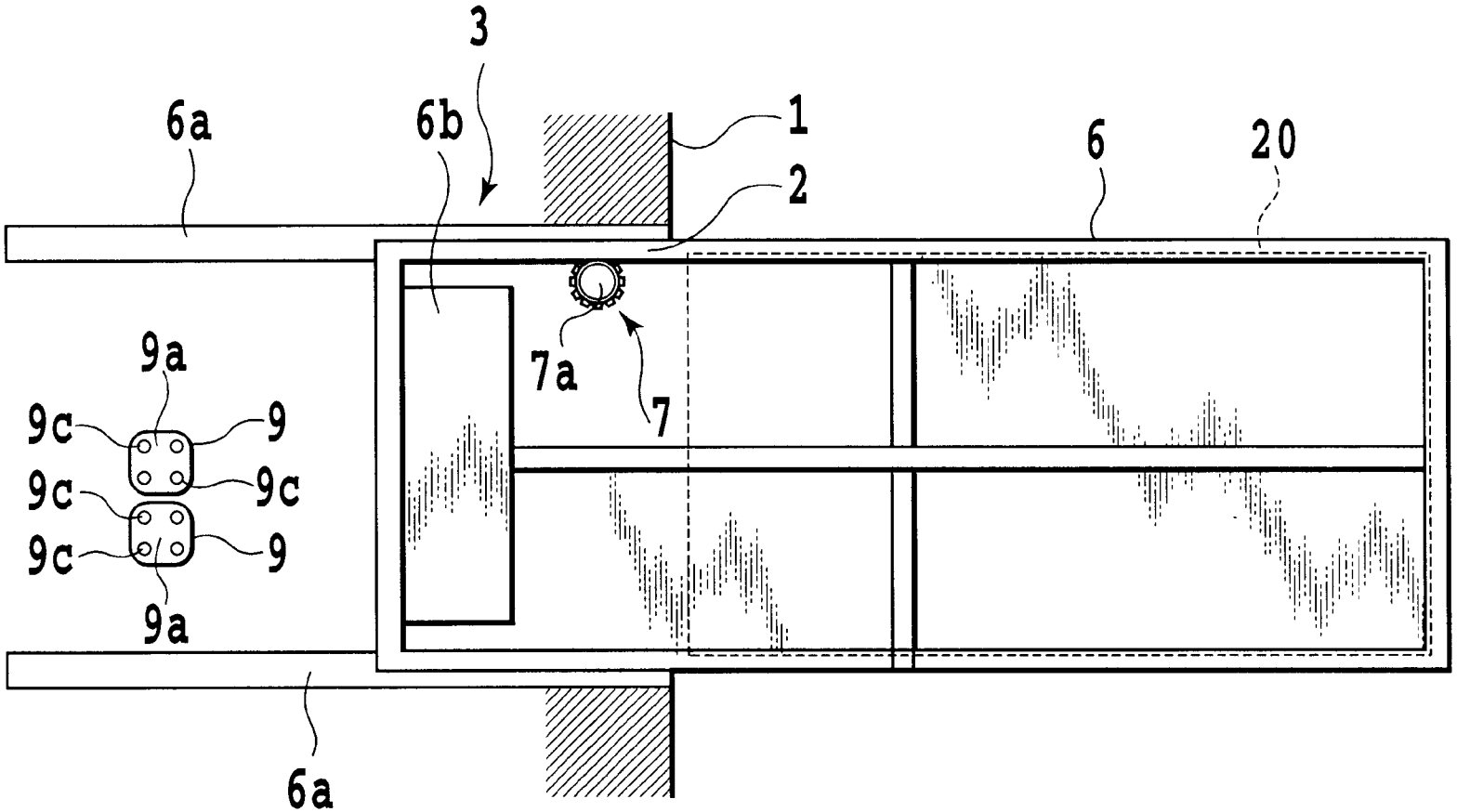
FIG. 4 is a schematic illustration showing an extendable container supporting member and a container supporting member driving means of the container supporting portion and the connecting portion for wiring and piping, in the preferred embodiment of the amusement facility.

On the other hand, as shown in FIG. 4, the container supporting portion 3 may have an extendable container supporting member 6 which can be extended from the opening portion 2 of the building 1 and mount the container 20 thereon. The extendable container supporting member 6 is engaged with two rails 6*a* formed on the floor surface adjacent to the opening portion 2 of the building for sliding movement. The rails 6*a* are arranged along the direction of carrying-in-and-out the container 20 for supporting the extendable container supporting member 6 for movement in the direction of carrying-in-and-out the container and preventing the extendable container supporting member 6 from tilting by the load of the container 20.

Moreover, the extendable container supporting member 6 has a rectangular and frame-like structure. On the rear end side of the extendable container supporting member 6, a weight 6*b* may be arranged for establishing a balance when the container 20 is mounted on the front side portion of the extendable container supporting member 6, as shown in FIG. 4. On the other hand, the extendable container supporting member 6 can be driven back and forth along the direction of carrying-in-and-out the container 20 by a container supporting member actuation means 7.

The container supporting member actuation means 7 comprises a rack (not shown) provided along the side edge portion of the bottom portion of the extendable container supporting member 6 and a pinion 7*a*, for example, so that the extendable container supporting member 6 can be driven back and forth along the direction set forth above by driving the pinion 7*a* to rotate by a not shown electric motor. The container supporting member actuation means 7 is not specified to the rack and pinion 7*a*, but can be a hydraulic cylinder, a winch and wire, a chain and sprocket, a worm screw and so on, similarly to the container carrying-in-and-out actuation means.

In order to actuate hydraulic devices installed as a part of the amusement equipment in the container 20, hydraulic equipment becomes necessary in the amusement facility. Therefore, when the hydraulic cylinder is used in the container supporting member actuation means and the container carrying-in-and-out actuation means, a hydraulic pressure can be supplied from a hydraulic pressure supply apparatus for the amusement equipment. Therefore, it is not always required to install the hydraulic pressure supply apparatus only for the container supporting member actuation means or the container carrying-in-and-out actuation means.

On the other hand, in the building 1, wiring and piping to be connected to the wiring and piping on the container side 20 are arranged. Also, as shown in FIGS. 2 and 3, connecting portions 8 on the building side are provided for connecting with the wiring and piping on the container side. On the container 20 side, connecting portions 21 on the container side to be connected to the connecting portions 8 on the building side and connected to the wiring and piping of the container 20 are provided.

The connecting portion 8 on the building side includes a supporting member 8*a* fixedly supported on the floor or the like and incorporating the wiring and piping, a connecting member 8*b* provided on the side surface of the supporting member 8*a* opposing to the container 20 and round bar-shaped projecting portions 8*c* provided to frontwardly project from the connecting member 8*b*.

The connecting member 8*b* is designed such that it can slightly slidingly move in lateral and vertical directions with respect to the supporting member 8*a* by means of a guide member or engagement of an elongated hole with a bolt, and is connected with the supporting member 8*a* via a resilient member (not shown). The front surface of the connecting member 8*b* forms a surface perpendicular to the direction of carrying-in-and-out the container 20. The connecting member 8*b* is located at a position to be connected with the connecting portion 21 of the container 20 arranged on the container supporting portion 3.

On the front surface portion of the connecting member 8*b*, a connector for a power source wiring, a connector (not shown) for a signal wiring, a connector (not shown) for various piping are mounted. These connectors are placed in a condition to be connected with the wiring and piping on the building 1 side. The portions to be connected with the connectors of the wiring and piping are flexible so as not to interfere movement in lateral and vertical directions of the connecting member 8*b*.

The connecting portion 21 is fixed on the container side and is arranged to place the front surface thereof to be perpendicular to the direction for carrying-in-and-out the container 20. On the other hand, in the connecting portion 21 on the container side, a substantially funnel-like holes 21*a* are formed at positions corresponding to the projecting portions 8*c* of the connecting portion 8 on the building side. Upon inserting the projecting portions 8*c* into the holes 21*a*, by conical portions of the holes 21*a*, the projecting portions 8*c* are guided. By further inserting the projecting portions 8*c* into the deeper cylindrical portions of the holes 21*a*, positioning is achieved.

On the front surface portion of the connecting portion 21 of the container, connectors corresponding to the connectors of the wiring and piping provided in the connecting portion 8 on the building side are provided, to these connectors, wiring and piping arranged in the container 20 are connected. It is also possible to alternate the constructions of the connecting portion 21 on the container side and the connecting portion 8 on the building side. Also, the connecting portion 21 on the container side may be connected to the container 20 for sliding movement in lateral and vertical directions via a resilient member.

Connection between the connecting portion 8 on the building side and the connecting portion 21 on the container side is established in the following manner, for example. Upon taking in the container 20, the container 20 is slidingly moved on the container supporting portion 3 up to the container installation position. During sliding movement, the connecting portion 21 on the container side is moved toward the connecting portion 8 on the building side. When the container 20 reaches the installation position, the connecting portion 8 on the building side and the connecting portion 21 on the container side are connected. At this time, by combination of the projecting portions 8*c* and the holes 21*a*, the connecting portion 21 on the container side and the connecting portion 8 on the building side are accurately positioned, and connectors provided in respective connecting portions 8 and 21 are connected with each other.

Upon connection between the connecting portions 8 and 21, the resilient members may absorb shock and, in conjunction therewith, bias the connecting portions 8 and 21 to be connected to each other by resilient forces thereof to be held in biased condition.

The connecting portion 8 on the building side and the connecting portion 21 on the container side are not limited to the constructions set forth above. For example, as shown in FIG. 4, it may be a construction, in which the connecting portion 9 on the building side is provided on the floor surface or the container supporting portion 3 at the position of the building 1 where the container 20 is installed, and a not shown connecting portion on the container side is provided on the bottom surface of the container 20. On the other hand, the connecting portions 9 on the building side and connecting portions on the container side are divided into two for wiring and piping.

In the connecting portions 9 on the building side, a horizontally oriented plate form connecting member 9*a* is arranged for up and down movement by a not shown actuator, and is provided with projecting portions 9*c* similar to the projecting portions 8*c* set forth above. Also, the connecting members 9*a* are slightly and slidingly movable in lateral and horizontal directions, similar to the connecting member 8*b*.

On the other hand, a not shown connecting portion on the container side is formed similarly to the connecting portion 21 on the container side except for horizontal arrangement with downward orientation. Connection between the connecting portions 9 and the connecting portion of the container is performed in the similar manner as that between the connecting portions 8 and 21 except for elevating up and down by the elevating means. Orientations of the connecting portion 9 on the building side and the connecting portion on the container side corresponding to the former are not specified to be horizontal as long as they are opposed to each other and one is movable toward the other.

Then, wiring arranged in the building 1 and the container 20 are wiring for power supply and wiring for various signals. The wiring for various signals may be an optical fiber. On the other hand, the various signals may include detection signals from various sensors, control signals for controlling the amusement equipment in respective containers, data signals for updating program in each amusement equipment, data of video images, moving pictures, sound or the like to be used, and so on.

The piping arranged in the building 1 and the container are for air conditioning, water supply and drainage, hot water supply, hydraulic pressure, compressed air, coolant, smell(aroma), hot air and cool air and so on. The piping for hydraulic pressure is for amusement equipment, such as those to hydraulically actuate a cockpit, such as a simulator. On the other hand, a compressed air is used upon actuating a movable portion of the amusement equipment in the container 20 by means of an air cylinder. On the other hand, the compressed air may also be used for locally providing a feeling of wind. On the other hand, the coolant is used for cooling the amusement equipment for providing a feeling of coldness. On the other hand, smell or aroma are for feeding a gas or a liquid containing an aroma chemical, for example, and used in the amusement equipment for providing a feeling of the smell. Hot air and cool air may be for air conditioning, and for providing abrupt temperature variation or a feeling of the wind of hot or cold air. Water supply and drainage and hot water supply are used for water associated equipment, such as a normal vanity room, and are used for amusement equipment using water such as amusement equipment taking, for example, ships, falls and the like as a motif.

Next, an elevating means for elevating the container 20 up and down will be described. As set forth above, when the extendable container supporting member 6 is used in the container supporting portion 3, basically, it is possible that a normal crane (not shown) is used as the elevating means to hang the container 20, and then to mount the container 20 on the extendable container supporting member 6 in the condition extended from the opening portion 2 of the building 1 to perform taking in of the container 20. To the contrary, it is also possible, by connecting a wire of the crane to the container 20 mounted on the extended container supporting member 6, to lift off the container 20, and then to take out the container 20. As the crane, a self-propelled crane may be used. In the alternative, a crane arranged on the rooftop of the building for lifting up constructional materials, may be left for use in lifting up and down the container 20. On the other hand, a crane permanently installed on the rooftop for transportation of materials or for exchanging of the container 20.

Figure 5:
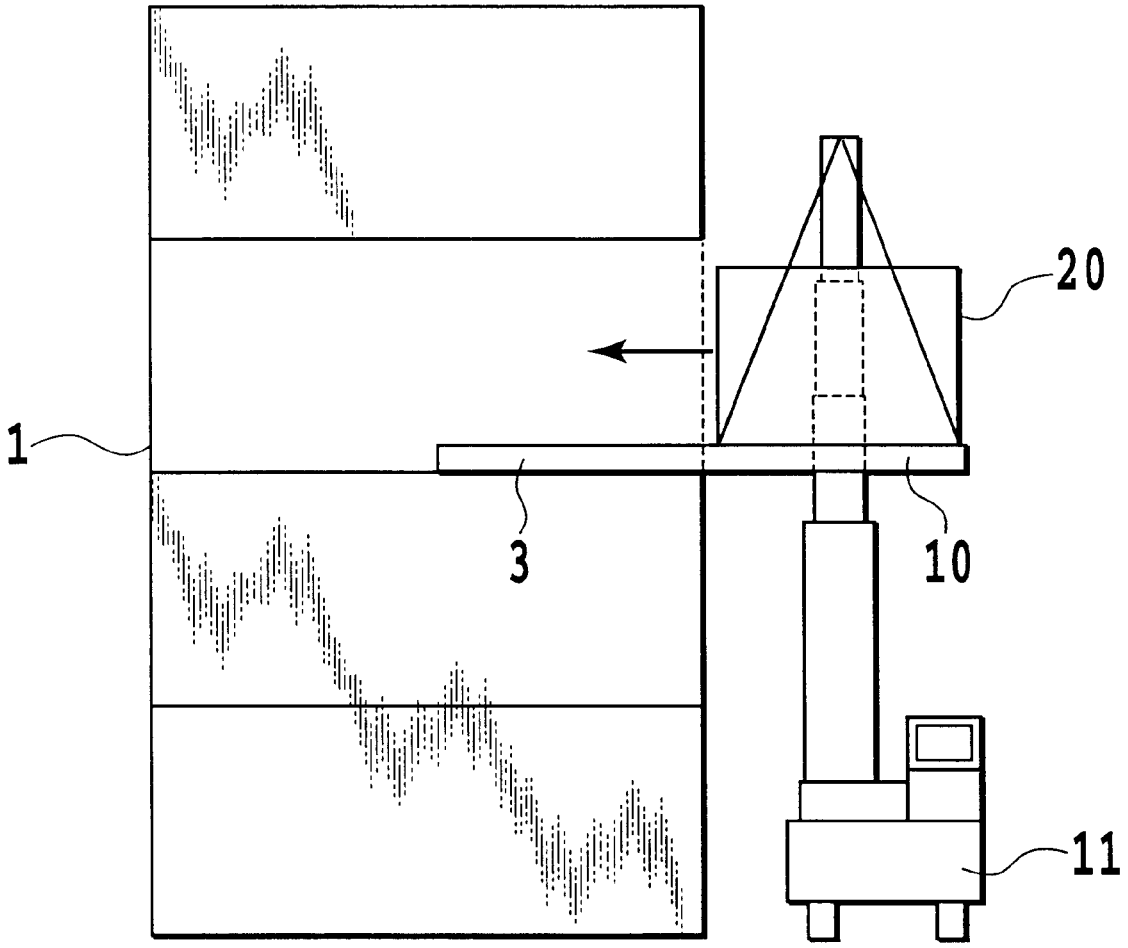
FIG. 5 is a schematic illustration showing elevating and carrying in the container by elevating means in the preferred embodiment of the amusement facility.

When the container supporting portion 3 is not the type that is extendable from the building such as the extendable container supporting member 6, for example, the rails 4, one having a sliding supporting member 10 may be used as a hanging tool, as shown in FIG. 5. The sliding supporting member 10 is hanged by a wire of a crane or the like and can move the container 20 in the direction of carrying-in-and-out. The sliding supporting member 10 has rails, for example, similar to the rails 4 of the container supporting portion 3 so as to support the container 20 movably in the carrying-in-and-out directions thereof.

Upon taking in the container 20, for example, as shown in FIG. 5, the sliding supporting member 10 in a condition mounting the container 20 is lifted by a crane 11 and moved to be substantially mate with the container supporting portion 3 so that the sliding supporting member 10 becomes substantially continuous with the container supporting portion 3 arranged adjacent to the opening portion 2 of the building 1. Then, for example, by drawing the container 20 on the sliding supporting member 10 from the building side, the container 20 can be transferred onto the container supporting portion 3.

Figure 6:
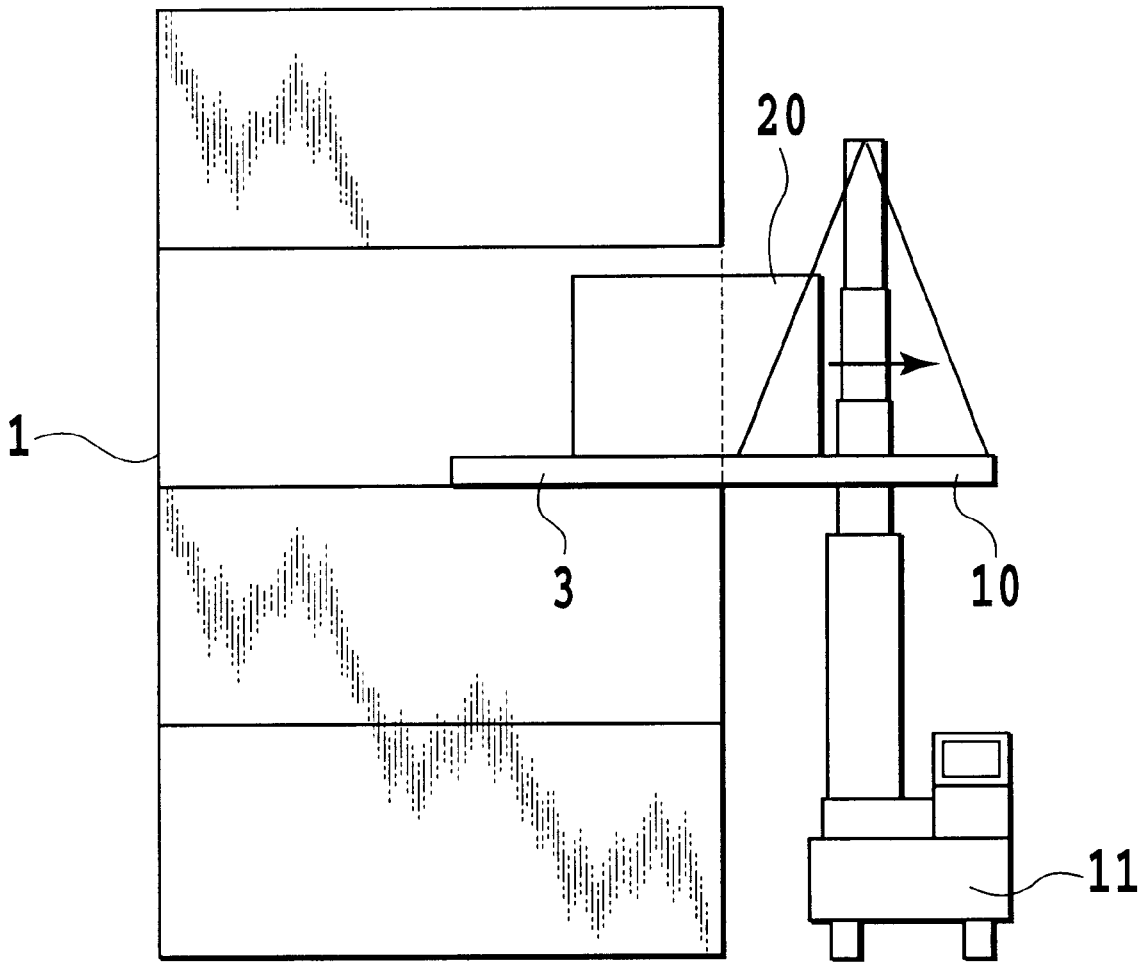
FIG. 6 is a schematic illustration showing elevating and carrying in the container by elevating means in the preferred embodiment of the amusement facility.

On the other hand, as shown in FIG. 6, upon taking out the container 20, an empty sliding supporting member 10 is lifted by the crane 11 and moved to be substantially mate with the container supporting portion 3 so that the sliding supporting member 10 becomes substantially continuous with the container supporting portion 3 arranged adjacent to the opening portion 2 of the building 1. Then, by pushing the container 20 on the container supporting portion 3 from the building side, for example, the container 20 is fed out onto the sliding supporting member 10, and then the sliding supporting member 10 together with the container 20 are lifted down.

Upon drawing and pushing of the container 20, it may be possible to use the foregoing container carrying-in-and-out actuation means. It is also possible to provide a container carrying-in-and-out means similar to the container carrying-in-and-out actuation means on the sliding supporting member 10 side to perform transfer of the container between the container supporting portion 3 and the sliding supporting member 10.

In the sliding supporting member 10, as a member for movably supporting the container 20, one other than rails may be used similarly to the case of the container supporting portion 3. On the tip end portion of the sliding support member 10 directed toward the building 1, a connecting member may be provided for detachably connecting with the building, for example. With such a construction, upon transfer of the container 20, the sliding supporting member 10 can be stabilized.

Figure 7:
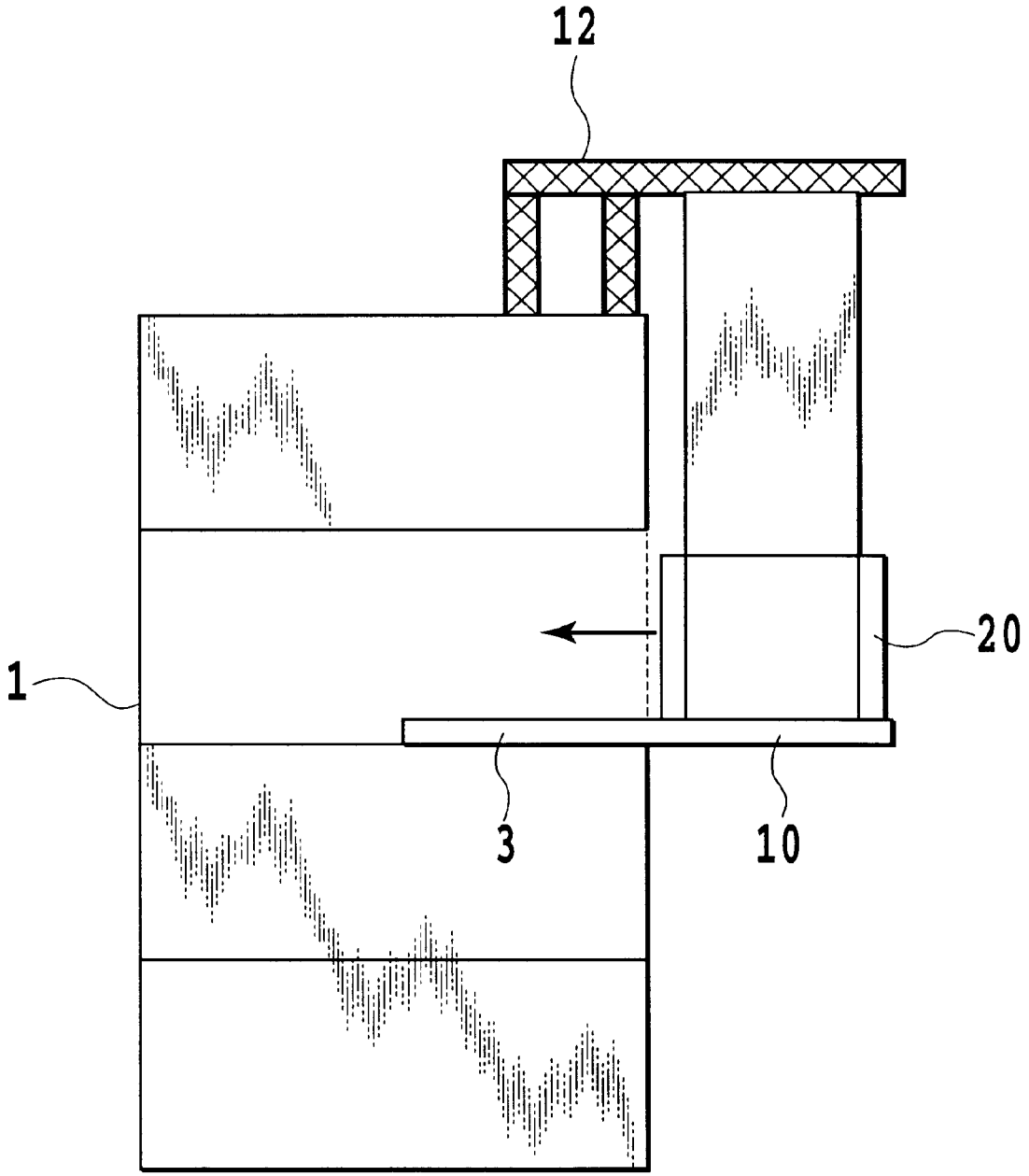
FIG. 7 is a schematic illustration showing elevating and carrying in the container by elevating means in the preferred embodiment of the amusement facility.

On the other hand, as the elevating means, a crane 12 dedicated for the container 20 may be provided on the rooftop of the building 1 as shown in FIG. 7, in place of the crane 11 set forth above. The crane 12 is movable in lateral directions on rails extended on the rooftop. The sliding supporting member 10 may be more stable by arranging a plurality of wires in a substantially vertical direction. The basic carrying-in-and-out method of the container 20 is similar to that employing the crane 11.

Next, explanation will be given for the container.

The container 20 is formed as a framework 25 constituted of a rectangular frame form top frame 22 which is arranged in the ceiling portion, a rectangular frame form bottom frame 23 arranged in the bottom portion, pillar frames 24 extending at respective four corners of the frames 22 and 23. The framework 25 has a substantially rectangular parallelepiped shaped configuration.

Since the container 20 is transported through a road, a size of the container 20 is restricted by a traffic regulation, and is also restricted by a size of the road and obstacles on the road. Furthermore, the size of the container 20 is restricted by a size of the building 1. For example, a typical size of the container 20 may be 5 m in width, 5 m in height and 12 m in length. However, the container may be greater or smaller than the typical dimension. It should be noted that, for convenience in transporting, the container 20 may also be separated into a plurality of fractions.

The size of the container 20 is preferably standardized into one kind in consideration of productivity of the container, workability upon installation of the container 20 in consideration of standardization of the container supporting portion 3 or the like on the building 1 side. However, since dimensions of the amusement equipment to be installed in the container and/or dimensions of the building 1 may be different in each individual amusement equipment and/or building, a plurality of kinds of dimensions of the containers may be standardized in consideration of variation of the dimensions of the amusement equipment and the building.

Moreover, since the dimension of the container 20 is restricted as set forth above, it is not always necessary to install entire amusement equipment within one container 20. It is thus possible to divide the amusement equipment into a plurality of fractions corresponding to the size of the container and the fractions are installed in the containers 20, respectively.

Figure 9:
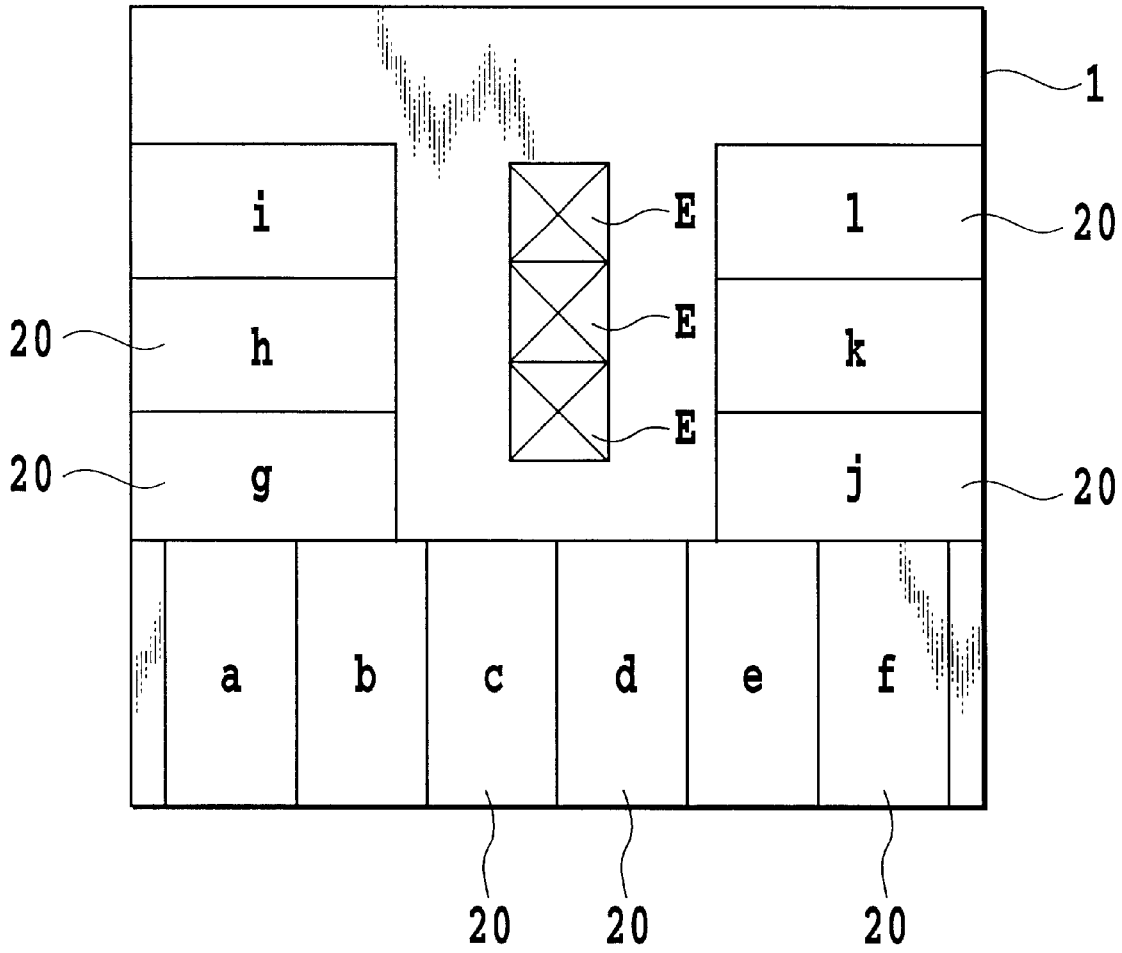
FIG. 9 is a schematic illustration showing an arrangement of the container in the building in the amusement facility in the preferred embodiment of the amusement facility.

In this case, an arrangement of the containers 20 containing respective of the separated fractions of the amusement equipment is selected so that one amusement equipment is formed with a plurality of containers 20 aligned in a line when the containers 20 are arranged in the building 1 as shown in FIG. 9.

For example, with the containers 20 of a to f, one amusement equipment is constructed; with the containers 20 of g to i, another amusement equipment is constructed; and with the containers 20 of j to l, the other amusement equipment is constructed. By constructing one amusement equipment by sequentially connecting the containers 20 aligned in a line, the pillar frames 24 of the container 20 are placed in peripheral portions of a space defined by the aligned containers 20 and never be arranged in the central portion of the space, permitting free use of the space thus defined. It should be noted that reference signs E denote elevators.

Figure 10:
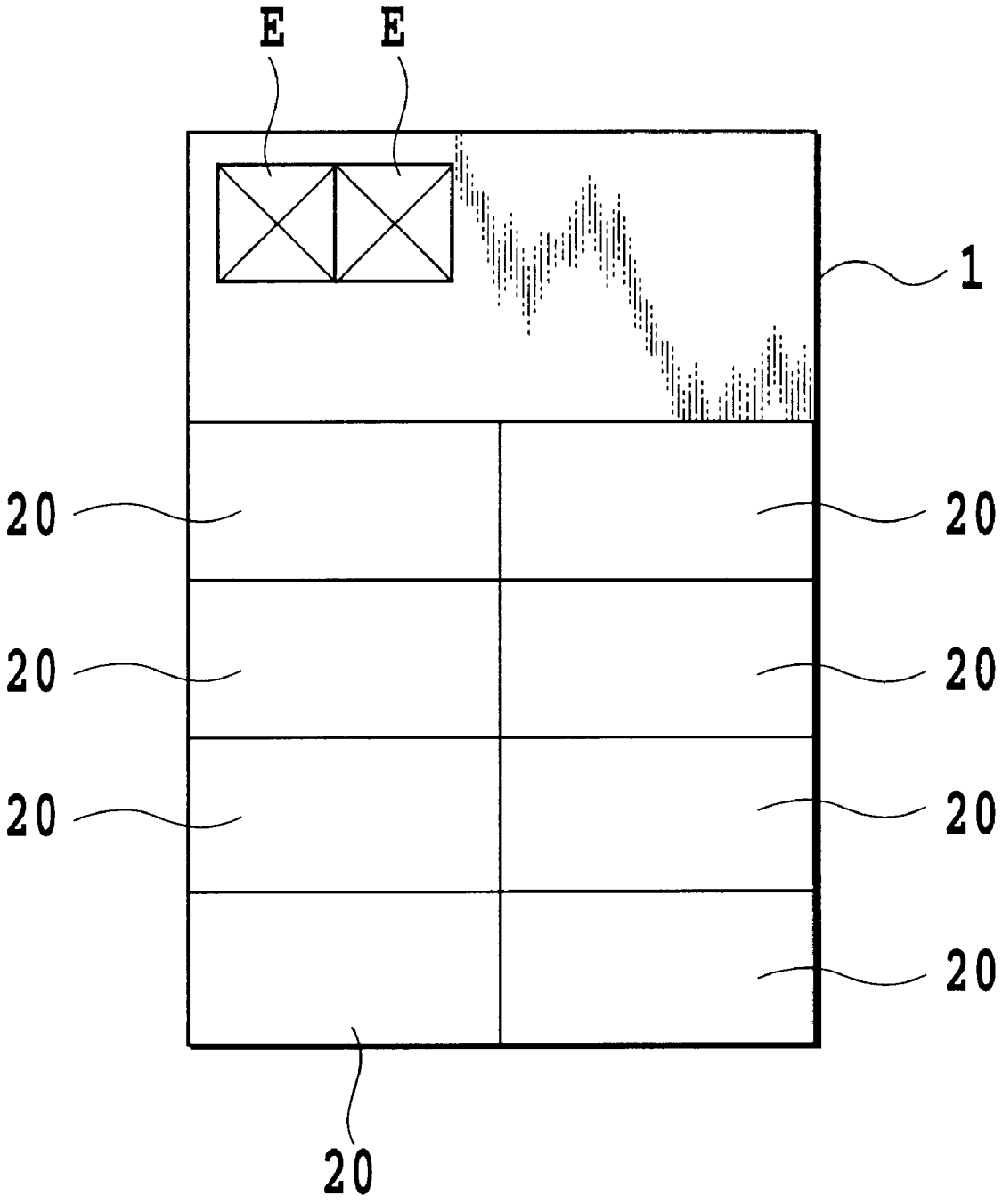
FIG. 10 is a schematic illustration showing an arrangement of the container in the building in the amusement facility in the preferred embodiment of the amusement facility.

When a plurality of containers 20 arranged in a plurality of rows, as shown in FIG. 10, or when spaces in the containers 20 of a, b and g shown in FIG. 9 are used as one space, the pillar frames 24 are located not only in the peripheral portions of the space but also at the central portion of the space to restrict use of the space by the pillar frames 24. However, it is possible that the pillar frames 24 located at the central portion in the space may be effectively used in installation of the amusement equipment and not necessarily disadvantage condition.

It should be noted, in the container 20, respective frames 22 to 24 and members forming the rectangular top frame 22 and the bottom frame 23 may be detachably connected by bolts, joint metals or the like. By this, it becomes possible to remove some of the pillar frames which interfere building up of the amusement equipment by joining a plurality of containers 20. Also, when some of the pillar frames are removed, the top frames and the bottom frames of adjacent containers 20 may be joined with each other to mutually support them.

On the other hand, in the individual containers 20, when one or more of or all of the pillar frames 24 are removed, the top frame 22 and the bottom frame 23 may be connected to the building 1 so as to be supported by the building 1. With such a construction, it becomes easy to determine whether or not the pillar frames 24 are to be present in the space defined by combined plurality of containers.

Figure 11:
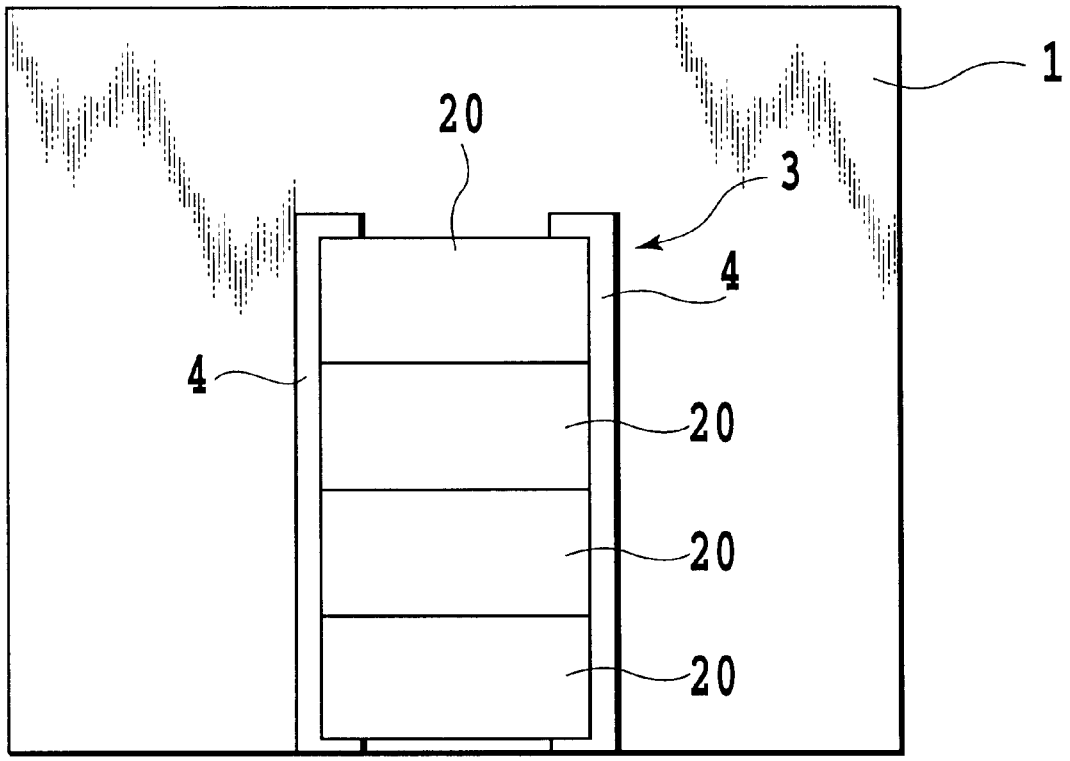
FIG. 11 is a schematic illustration showing an arrangement of the container in the building in the amusement facility in the preferred embodiment of the amusement facility.

On the other hand, as shown in FIG. 11, upon arranging the containers 20 within the building 1, a plurality of containers 20 are fed in through one opening portion so as to be sequentially connected in alignment. By this, upon building up one amusement equipment from a plurality of containers 20, the plurality of containers 20 can be easily installed. In this case, difficulty is encountered to exchange only one container 20 located remote from the opening portion in the sequence of the containers 20. However, a possibility to cause necessity of exchanging only one container 20 is low, when building up one amusement equipment from a plurality of containers 20, no significant problem will be encountered.

Figure 12:
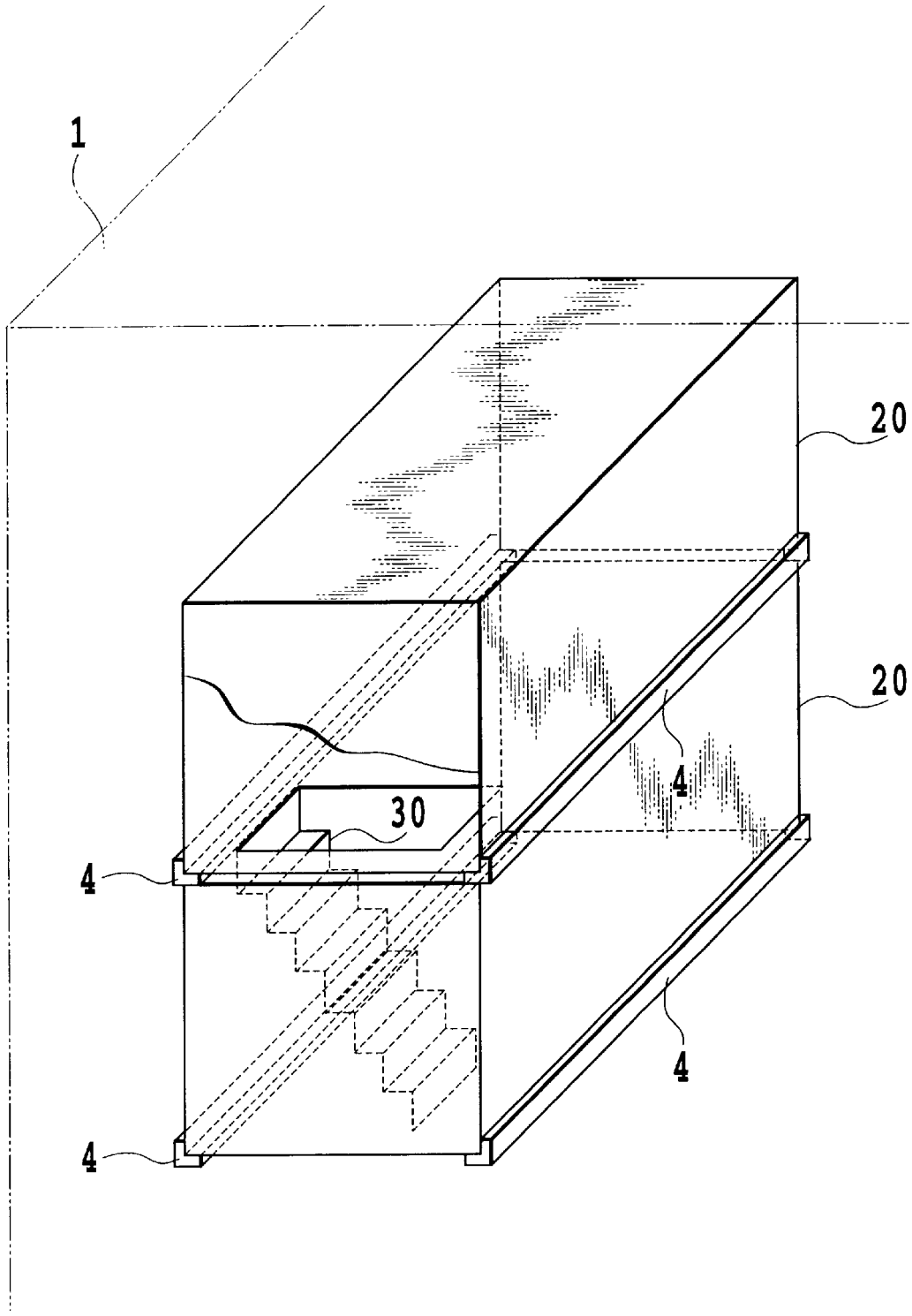
FIG. 12 is a schematic illustration showing an arrangement of the container in the building in the amusement facility in the preferred embodiment of the amusement facility.

As shown in FIG. 12, it is possible to form a space for installing amusement equipment by vertically joining containers 20. In this case, a part of the top frame 22 or the bottom frame 23 may interfere installation of the amusement equipment. Therefore, it may be possible to remove a part of the members forming the top frame 22 and the bottom frame 23. On the other hand, when the containers 20 are jointed vertically, a floor slab of the building 1 may interfere formation of the installation space of the amusement equipment. Therefore, the containers 20 may be vertically joined in a structure having no floor slab or in a portion where the floor slab is not present further, in the containers 20 jointed vertically, an up and down moving means, such as stairs, an elevator or the like, may be provided in the vertically jointed containers 20.

Upon connecting adjacent containers 20, it is preferred to provide connecting structures at respective connecting portions. For example, when floor panels are to be connected between adjacent containers 20, it is preferred that the floor panel of one container 20 is designed to be extended toward the adjacent container 20 by pivotal or sliding movement, and a cutout accommodating the extended portion of the floor panel of one container may be formed in the floor panel of the other container 20.

On the other hand, the wiring or the like for signals may be connected between the adjacent containers 20 via connecting portions 8 and 21 (building), or in the alternative, may be connected directly by providing connectors separately from the connecting portions 8 and 21.

Figure 8:
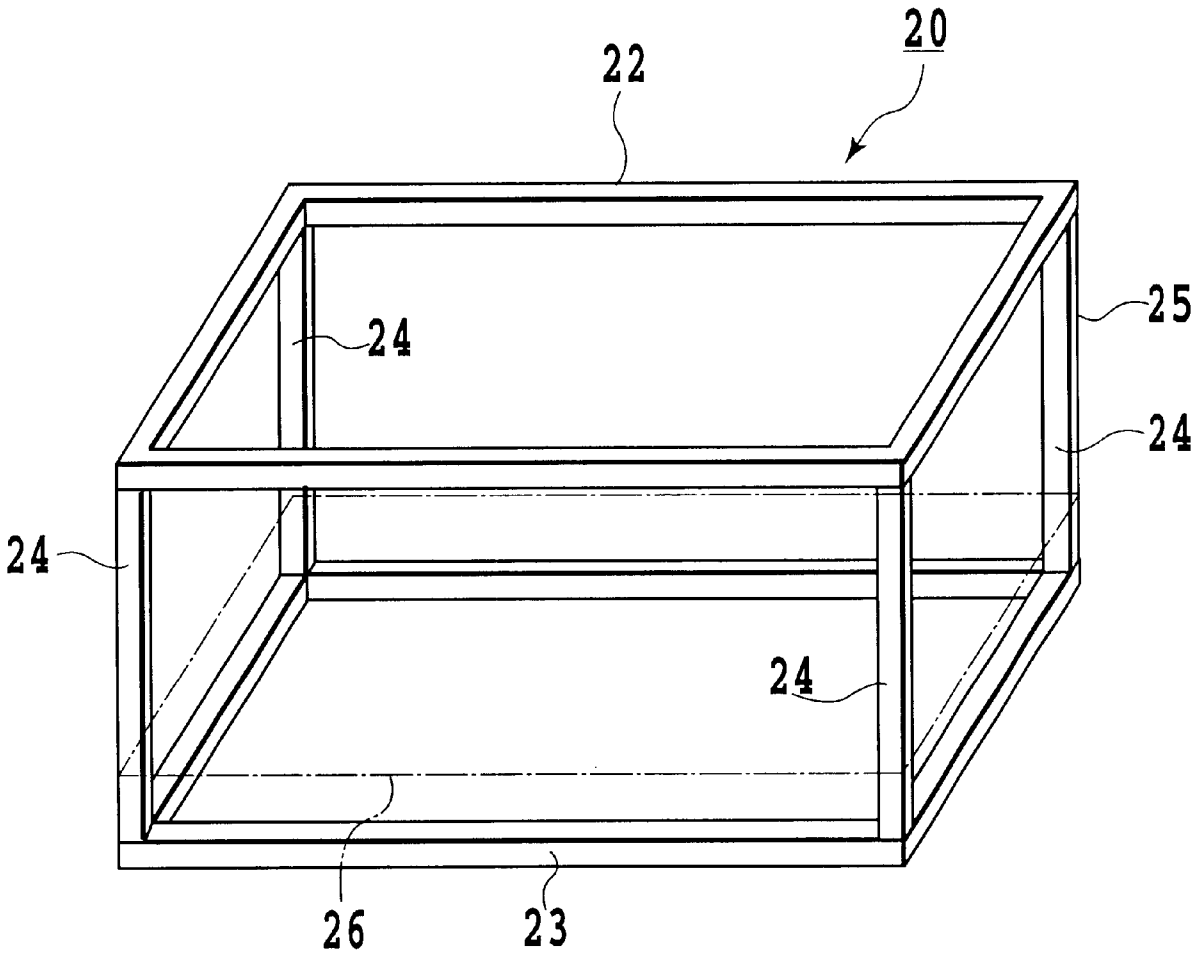
FIG. 8 is a schematic perspective view showing a container for the amusement facility in the preferred embodiment of the amusement facility.

In the container 20, amusement equipment is installed. In the amusement equipment, an interior design, such as piping, wiring, floors, ceilings, walls and so on may be included. Then, as shown in FIG. 8, for example, a floor panel 26 is arranged at a distance spaced apart from the bottom surface of the container 20 for arranging the wiring and piping in a clearance defined between the bottom frame 23 of the container 20 and the floor panel 26. In the alternative, it is also possible to define a clearance between the top frame 22 of the container 20 and a ceiling to arrange the wiring and piping in this clearance. Also, partitioning walls may be provided in the container. It is further possible to arrange the wiring and piping in other portions.

On the container 20, face plates may be installed for the portions which are not required to form openings. In the alternative, the face plates may be attached on the container as covers upon transportation and removed upon installation. The face plates may also be used as reinforcement. Also, auxiliary frames may be mounted in addition to the frames shown in FIG. 8. Furthermore, a frame for mounting various members may be mounted in the container 20. On the other hand, auxiliary frames or the like may be removed upon installation.

Figure 13:
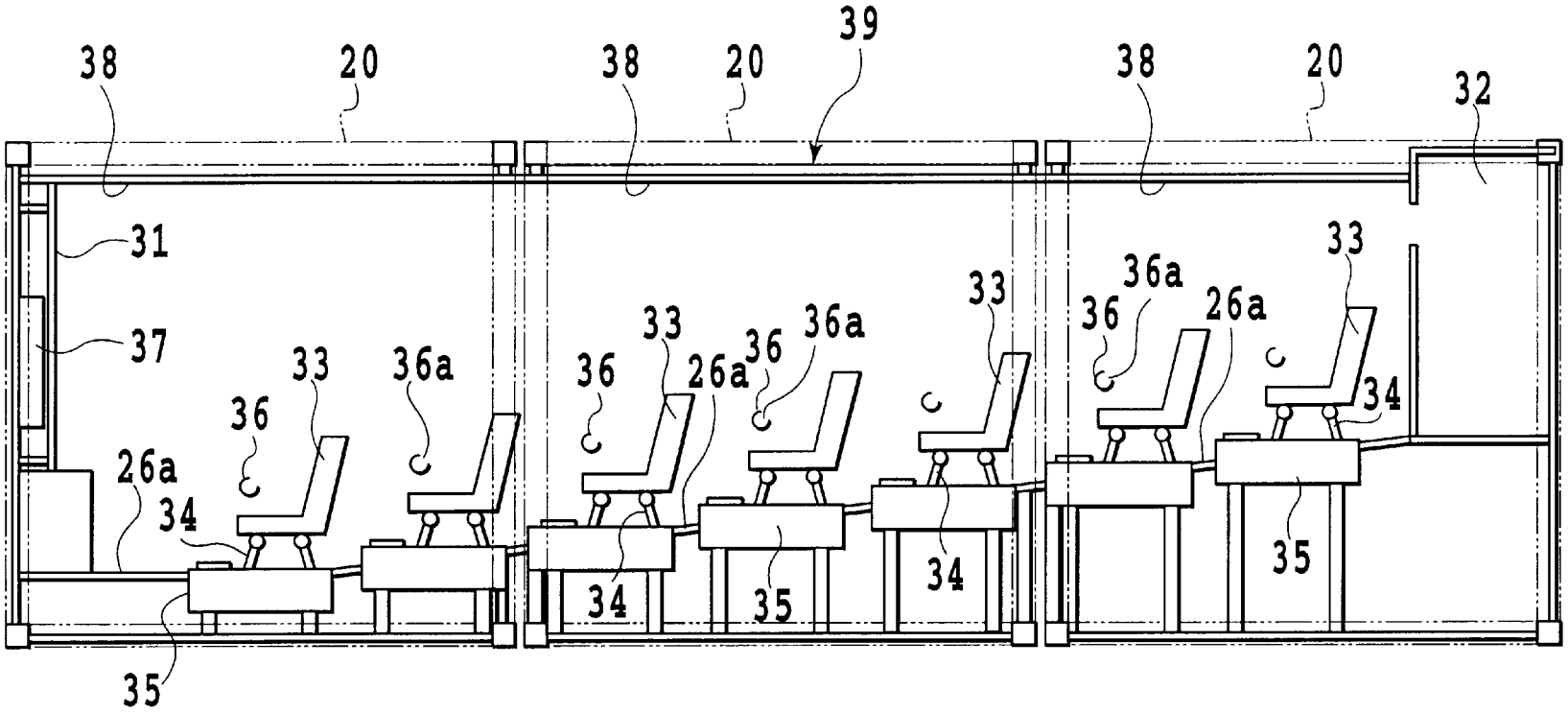
FIG. 13 is a schematic illustration showing a movie theater arranged in the container in the building in the amusement facility in the preferred embodiment of the amusement facility.
Figure 14:
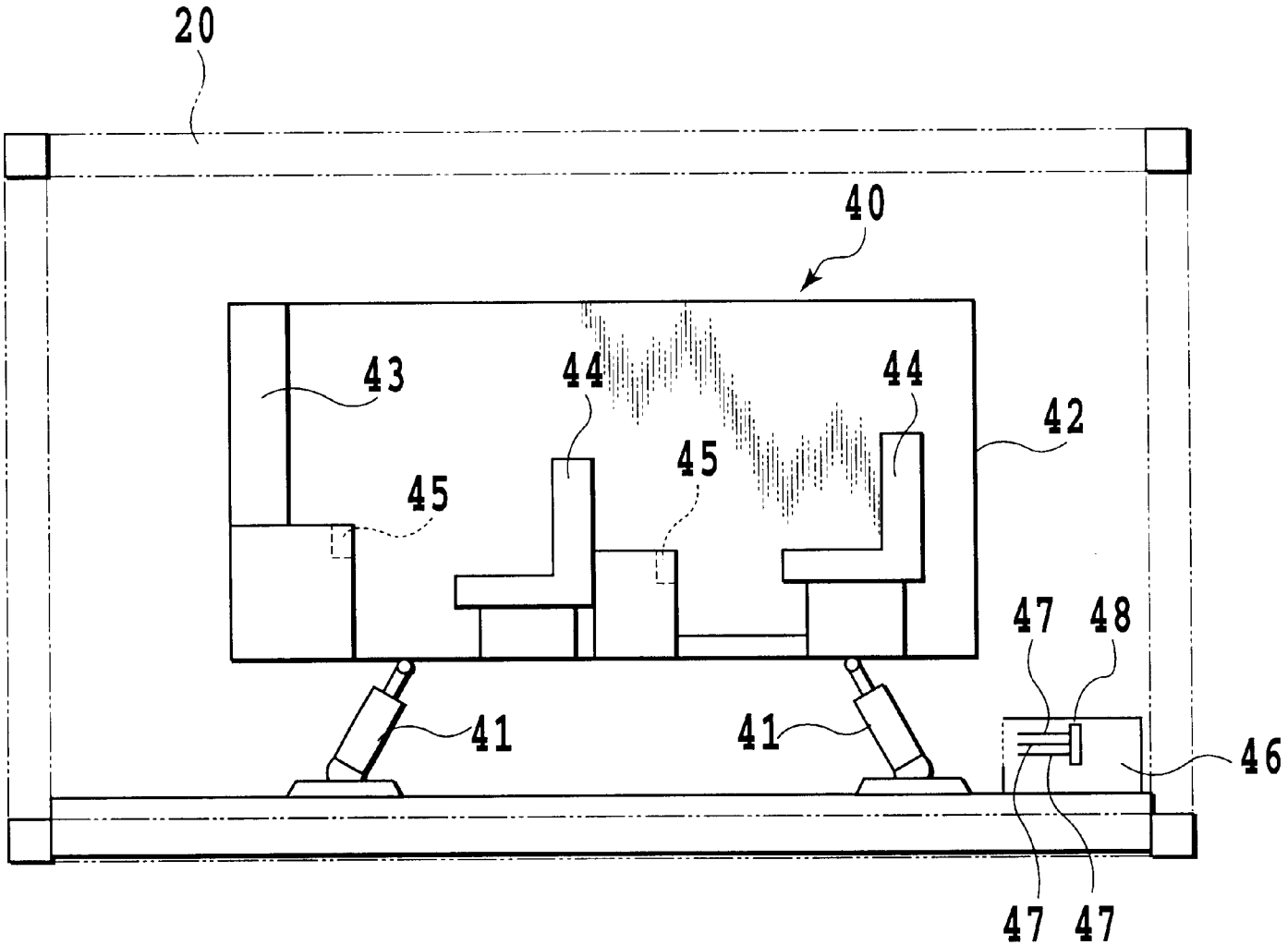
FIG. 14 is a schematic illustration showing a simulator arranged in the container in the building in the amusement facility in the preferred embodiment of the amusement facility.

One of the amusement equipment to be mounted in the containers 20, may be a movie theater 39 including a screen 31 and projecting equipment (not shown, arranged in a projection booth 32) as shown in FIG. 13, for example.

For example, a plurality of the movie theaters 39 may be arranged within the building to form a cinema complex. In the alternative, the movie theater 39 may project a three-dimensional video. The screen may be hemisphere or a multi-screen. Also, the movie theater 39 may provide a feeling of smell or aroma, a feeling of temperature or the like, an acceleration feeling or an up and down feeling by moving a seat or the like, in addition to video and audio. Namely, in the movie theater 39 as amusement equipment, viewers may feel smell, temperature (including hot wind, cold wind), acceleration, up and down acting on senses provided for human being, so called five senses, in addition to the video and audio.

For example, in the movie theater 39 shown in FIG. 13, a space for the movie theater 39 is formed by sequentially joining a plurality of containers 20 together. Then, in the movie theater 39, chairs 33 are vertically movable independently in back and forth and lateral directions by a plurality of hydraulic cylinder apparatuses 34. By this, an accelerating feeling, an elevating feeling, vibrations as riding on the vehicle, can be experienced.

In the movie theater 39 shown in FIG. 13, the hydraulic cylinder apparatuses 34 are supported by cylinder supporting portions 35 lower portion of each hydraulic cylinder apparatus 34 is covered and concealed. On the other hand, an upper end portion of the hydraulic cylinder apparatus 34 is connected to the chair 33 in a rockable fashion, and a lower end portion thereof is rockablly connected to the cylinder supporting portion 35. Further, piping (not shown) for feeding hydraulic pressure to the hydraulic cylinders 34 is arranged below the floor panel **26*a* in the container 20, and is connected to the above mentioned connecting portion 21 on the container side. Thus, by connecting the connecting portion 8 on the building side and the connecting portion 21 on the container side, the hydraulic pressure may be supplied from the outside of the container 20**.

On the other hand, control of the hydraulic cylinder apparatus 34 (including electromagnetic valves) and the projection equipment is performed by a control unit (arranged in one of a plurality of containers shown in FIG. 13). The control unit can be operated (or controlled) from a control terminal for concentrated management arranged in the container 20 having utility equipment. By wiring for signals connected by the connecting portions 8 and 21, control signals and output signals from various sensors are exchanged between containers 20 to permit control from the control terminal.

In the chair 33, a hand-rail 36 to be gripped by the viewer when the chair is actuated by the hydraulic cylinder apparatus 34. The hand-rail 36 is arranged in front of the viewer seating on the chair 33 from the above or below the chair during playing the movie. In a portion of the hand-rail 36 opposing to the viewer, air discharge holes 36*a* are formed. On the other hand, within the hand-rail 36, not shown piping for smell, cool air, hot air and a wind blowing are arranged so that a wind added smell by an aroma chemical, a room temperature wind, cold air, and hot air are blown at a controlled timing by electromagnetic valves and the control unit. By this, the viewer can feel smell, winds, cold air, hot air and the like in addition to vide and audio. It is also possible to provide a switch to place the air discharge holes 36*a* in a closed condition (condition where no smell, wind, cold air hot air is blown).

The piping for smell, cold air, hot air and winds are also connected to the building 1 side through the connecting portions 8 and 21. In addition, piping for air conditioning, wiring for power supply, wiring for various signals are also connected to the building 1 side via the connecting portions 8 and 21. By installing the containers 20 respectively installed with respective parts of the movie theater 39 and connecting the connecting portions 8 and 21, the equipment in the containers 20 can be used.

In the movie theater 39 formed by the equipment in the containers 20, known stereophonic equipment (not shown) including a center speaker 37 behind the screen 31 is provided. On the other hand, in the movie theater 39 constituted of the equipment in the containers 20, air conditioning equipment connected to the piping for air conditioning and lighting equipment connected to the wiring for power supply are provided. Then, respective equipment for sound, air conditioning and lighting are installed in respective containers 20 provided with basically different amusement equipment, and are connected to the control terminal via the connecting portions 8 and 21 to commonly control respective containers 20 from the control terminal.

Accordingly, even when the amusement equipment is changed by exchanging the containers 20, respective equipment for sound, air conditioning and lighting can be controlled from the central management control terminal.

While the sound and video of the movie may be preliminarily provided on the container side 20, but can be supplied in the container 20 from the outside of the container 20 by connecting the wiring for signals through connection between the connecting portions 8 and 21.

On the other hand, when one amusement equipment such as the movie theater 39 from a sequentially connected plurality of containers 20, equipment present over the containers 20, such as interior materials, including the floor panel 26*a*, the ceiling panel 38, and interior panel (not shown) and the like, become necessary. Connecting portions of such equipment are connected after installation of the containers 20 within the building 1 on site. The connecting portions of the floors, walls ceiling or the like and connecting portions of other equipment may be extended from one of the containers toward the other, and engaging portions to engage with the extended portions are provided on the other container.

Amusement equipment to be installed in the container 20 may be a simulator apparatus 40 for a vehicle, such as an air plain arranged in one container 20. The simulator apparatus 40 is constructed with a plurality of hydraulic cylinder devices 41, a cockpit portion 42 supported for motion as actuated by the hydraulic cylinder devices 41, a display 43 arranged within the cockpit 42, chairs 44 provided in the cockpit and the like, and a not shown control device, to operate in the similar manner as known simulator for an air plain.

In the simulator apparatus 40 of this embodiment, an air discharge opening 45 performing similar functions as the air discharging holes 36*a* provided in the hand-rail 36 of the movie theater 39, is provided in front of the chairs 44. In the air discharge opening 45, not shown piping for smell, cold air, hot air and a wind are arranged. From the air discharge opening 47, a wind added smell by an aroma chemical, a room temperature wind, a cold wind and hot air are blown at a controlled timing by the electromagnetic valves and the control unit.

On the other hand, in the container 20, a control unit 46 for controlling the simulator 40 is provided. In the control unit 46, an electronic substrate 47, on which a storage semiconductor device for storing programs and various data (including video and audio data), CPU, and other semiconductor devices are mounted, is detachably mounted in a slot portion 48.

By exchanging the electronic board 47, the programs and the various data can be varied to simply vary each control relating to a content of play. On the other hand, since the programs and various data can be exchanged together with devices other than the storage device, it is also possible to change the content of play to play in which processing capability of the device is different. For example, it is possible to change from a play content having a small load to an arithmetic processing unit to perform an air battle within a range of a predetermined flight pattern of an air plain, to a play content requiring a substantial high load to an arithmetic processing unit to perform an air fight with simulating flight of an air plain corresponding to randomly varied weather and operation by a player.

The amusement facility active on five senses may be a facility, such as a sensory or virtual game machine, and also may permit playing mutual fighting by arranging the sensory or virtual game machines in a side-by-side relationship. Even in such virtual game machines, hydraulic pressure or pressurized air may be fed to a hydraulic apparatus or a pneumatic apparatus for driving the virtual game machines from the outside of the container 20 via the connecting portions 8 and 21, and also winds, cool air, a hot wind, smell or aroma and the like may be felt.

In other words, while the virtual game machine in the conventional game arcade has been operated alone to effect video display, sound reproduction, action and so forth by electric power and has been difficult to provide effects other than video display and sound reproduction, and cause a large stroke motion providing an acceleration feeling or an up-and-down feeling. To the contrary, in the amusement equipment arranged within the container 20, factors causing various effects may be provided from the outside of the container, resulting in easily establishing realer virtual game machines or an amusement space.

On the other hand, the amusement equipment is not limited to those set forth above and can be an actual vehicle moving on a floor surface or on rails. Even in such a case, a feeling of temperature, smell, aroma may also be experienced. Any amusement equipment to be enjoyed as amusement may be employed.

On the other hand, the equipment arranged within the container 20 is not limited to the amusement equipment, and can be utility equipment for supplying power, exchanging various signals, air conditioning, supplying hydraulic pressure, supplying pressurized air, supplying smell or aroma, supplying hot air and cool air, supplying and draining water, supplying coolant, supplying hot water and so on to the amusement equipment in other container 20.

Namely, in the container 20 for utility equipment, without employing a power plant in the building, power supply equipment for supplying power to the amusement equipment in other container, a control unit performing transmission and reception of the control signals, detection signals or data signals, hydraulic equipment supplying hydraulic pressure, an air compressor supplying compressed air, a general air conditioner, an air conditioner for feeding hot air or cool air, water supplying and draining equipment, a refrigerating machine for supplying coolant, a boiler for supplying hot water, a smell supplying device having a plurality of aroma chemicals for supplying smell or aroma and so on may be equipped. Also, utility equipment performing various control or the like for other container 20 for amusement equipment may be concentrically provided in one container.

The smell supplying device contains vessels storing various aroma chemicals to discharge aroma chemical from the vessel designated by the control unit and to evaporate the aroma chemical to feed with the air through the piping under pressure. On the other hand, in the container 20 for the utility equipment, a control terminal for concentric control, such as monitoring of signal output from the control units or detecting devices installed in other containers and detecting abnormality thereof may be provided.

In an installation method of the amusement equipment in the amusement facility as set forth above, the framework 25 of the container 20 is manufactured in a factory or the like, and the amusement equipment (including the interior design) and the utility equipment to be mounted on the framework 25 of the container 20 are manufactured in the factory. In the factory, the amusement equipment and/or the utility equipment are installed in the frameworks 25.

At this time, with the frameworks 25 of the containers 20 being fed on an assembly line, respective equipment can be mounted. The frameworks 25 to which different equipment are mounted can be fed on a common line to produce a plurality of kinds of containers 20 in one line. At this time, production is controlled by a control unit, and, for example, the equipment to be mounted on respective containers 20 may be controlled for recognition by identification factors, such as identification numbers or the like, provided on respective containers 20 to produce various kinds of containers on the common line.

On the other hand, on the building 1 side, the opening portion 2 is formed and the container supporting portion 3 is provided. The piping and wiring for the container 20 are installed and connecting portions 8 or 9 on the building side are installed. The building 1 may be existing one or newly constructed one.

Then, the manufactured container 20 is transported to the building 1 by a trailer truck for the container. Then, by the elevating means, such as the crane, the container 20 is lifted up to the opening portion. Then, the container 20 is fed into the opening portion 2 of the building 1. Further, the container 20 is transferred on the container supporting portion 3 to a place at the installation position, and thereafter, the container supporting portion 3 is rigidly secured to the building 1.

At this time, the wiring and piping on the building side and the wiring and piping on the container side are connected by the connecting portions 8 and 21. All of the containers 20 are installed. Also, connection between the amusement equipment (including interior design) respectively arranged in adjacent containers 20 and connection between the equipment (including interior design) on the building side and the amusement equipment in the container are established.

By this, the amusement facility is completed. Then, the completed amusement facility constitutes an amusement facility having a plurality of the amusement equipment which consist of amusement equipment formed by combining the amusement equipment in one container 20 or the amusement equipment in a plurality of containers 20.

Here, such amusement equipment can be installed in the buildings in various locations to permit a multi-facility operation to contribute for lowering of investment for a development of the amusement equipment. Furthermore, by mass producing of amusement equipment, the cost for the equipment can be lowered.

After completion of the amusement facility, if there is the amusement equipment lowering the marquee, the amusement equipment of lowered marquee may be replaced with new amusement equipment by carrying-in-and-out the containers. At this time, the amusement equipment can be exchanged with a little operation associating with taking the container in and out the building.

Accordingly, in comparison with an operation in that destructive removal of the large scale amusement equipment in the building and rebuilding of the amusement equipment in the building are carried out as in the prior art, an on-site operation can be reduced significantly, and an operation period in the site can be significantly reduced. As a result, investment cost can be remarkably reduced and a long down period can be avoided.

By this, exchanging of the amusement equipment can be facilitated to recover marquee by replacing the amusement equipment which is tired of, with new amusement equipment. Furthermore, since the equipment in the amusement facility can be varied relatively frequently, repeater can be increased and marquee can be maintained over a long period at relatively low cost.

On the other hand, the container 20 taken out for exchanging the amusement equipment may be used in another amusement facility which has not been installed the same amusement equipment, after maintenance. Also, in the factory, in order to effectively use at least frameworks of the container 20, a part of or a whole amusement equipment is removed and install new amusement equipment therein to use as the container 20 containing the new amusement equipment.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An amusement facility constructed by installing one or more containers containing amusement equipment therein, within a building, characterized in that;

said building is provided with an opening portion for carrying-in-and-out said container, a container supporting portion is provided within said building for supporting said container to be carried-in-and-out through said opening portion, said container supporting portion includes a guide member formed in a portion adjacent to said opening portion in said building, and said guide member for guiding said container along a direction for carrying-in-and-out said container, container carrying-in-and-out actuation means for drawing said container from the outside of said building within said building along said guide member and pushing out said container arranged within said building along said guide member, wherein said container supporting portion includes an extendable container supporting member movable between a condition retracted into said building and a condition extended outwardly through said opening portion, and container supporting member actuation means for actuating said extendable container supporting member, whereby said extendable container supporting member takes said container in and out said building with said extendable container supporting member being moved in a condition mounting said container.

2. An amusement facility as claimed in claim 1, wherein said building is an existing one, said opening portion is formed in said existing building, and said container supporting member is provided in said existing building.

3. An amusement facility as claimed in claim 1, further comprising elevating means for elevating said container, and a sliding supporting portion is provided in said elevating means for slidably supporting said container with said building.

4. An amusement facility as claimed in claim 3, wherein, in said elevating means, container carrying-in-and-out means is provided for pushing said container supported on said sliding supporting portion in said building and drawing said container in said building onto said sliding supporting portion.

5. An amusement facility as claimed in claim 3, wherein said elevating means is one movable on a road.

6. An amusement facility as claimed in claim 3, wherein said elevating means is provided on said building.

7. An amusement facility as claimed in claim 1, wherein in said building, at least one of wiring and piping to be connected to said container is arranged and a building side connecting portion for connecting said at least one of wiring and piping to the container side is provided, in said container, at least one of wiring and piping to be connected to said building is arranged and a container side connecting portion for connecting said at least one of wiring and piping to the building side is provided, among said building side connecting portion and said container side connecting portion, at least one of connecting portions is movable toward the other of connecting portions, and one connecting portion being moved toward the other connecting portion to detachably connect said connecting portions with each other.

8. An amusement facility as claimed in claim 7, wherein a moving direction of said container from said opening portion when carried in and a moving direction of said container side connecting portion toward the building side connecting portion are consistent, and said container side connecting portion and said building side connecting portion are arranged so as to establish connection between said container side connecting portion and said building side connecting portion when said container is located at an installation position upon completion of movement of said container carried-in.

9. An amusement facility as claimed in claim 7, wherein said wiring is for performing at least one of power supply and transmission and reception of a signal, and said piping is for performing at least one of air conditioning, a hydraulic pressure supply, a compressed air supply, a smell supply, a hot air and cold air supply, a waster supply and drainage, a coolant supply and a hot water supply.

10. An amusement facility as claimed in claim 1, wherein in addition to said container, in which amusement equipment is provided, a container provided with utility equipment is supported on said container supporting portion in said building to be carried-in-and-out through said opening portion similarly to said container provided with said amusement equipment therein.

11. An amusement facility as claimed in claim 10, wherein said utility equipment in said utility equipment containing container performs at least one of a power supply and transmission and reception of a signal, air conditioning, a hydraulic pressure supply, a compressed air supply, a smell supply, a hot air and cold air supply, a waster supply and drainage, a coolant supply and a hot water supply, for said container provided with said amusement equipment therein.

12. An amusement facility as claimed in claim 1, wherein a plurality of said containers are arranged within one building to form an amusement space containing a plurality of amusement equipment.

13. An amusement facility as claimed in claim 1, wherein said opening portion and said container supporting portion of said building are provided corresponding to one or more sizes of standardized containers.

14. An amusement facility as claimed in claim 1, wherein a plurality of said containers installed adjacent with each other or connected with each other are communicated with each other through an opening portion formed in a wall across which said containers are adjacent, and amusement equipment contained in respective containers are combined to form an integrated single amusement equipment.

15. An amusement facility as claimed in claim 14, wherein said amusement equipment serving as integrated single amusement equipment as combined has a function comprising attraction equipment, movie projecting equipment, or video game equipment.

16. An amusement facility as claimed in claim 1, wherein said amusement equipment arranged in one or more containers is controlled by a signal input from outside of said container, in which said amusement equipment is arranged.

17. An amusement facility as claimed in claim 1, wherein a content of amusement in said amusement equipment arranged in one or more containers can be varied by exchanging an electronic board loaded in said amusement equipment.

* * * * *